US007755285B2

(12) United States Patent
Sasaki

(10) Patent No.: US 7,755,285 B2
(45) Date of Patent: Jul. 13, 2010

(54) PLASMA DISPLAY PANEL AND PLASMA DISPLAY APPARATUS

(75) Inventor: Takashi Sasaki, Hiratsuka (JP)

(73) Assignee: Fujitsu Hitachi Plasma Display Limited, Kawasaki-shi (JP)

( * ) Notice: Subject to any disclaimer, the term of this patent is extended or adjusted under 35 U.S.C. 154(b) by 1155 days.

(21) Appl. No.: 11/289,388

(22) Filed: Nov. 30, 2005

(65) Prior Publication Data

US 2006/0145626 A1 Jul. 6, 2006

(30) Foreign Application Priority Data

Nov. 30, 2004 (JP) ..... 2004-345575
Oct. 14, 2005 (JP) ..... 2005-300008

(51) Int. Cl.
*H01J 17/49* (2006.01)

(52) U.S. Cl. ..... 313/585; 313/583; 313/584; 313/586; 313/587

(58) Field of Classification Search ..... 313/582–587
See application file for complete search history.

(56) References Cited

U.S. PATENT DOCUMENTS

| | | | | |
|---|---|---|---|---|
| 6,172,461 | B1 | 1/2001 | Ha | |
| 7,425,796 | B2 * | 9/2008 | Mizuta | 313/582 |
| 2002/0050792 | A1 * | 5/2002 | Shirozu | 313/586 |
| 2002/0053875 | A1 * | 5/2002 | Kanazawa et al. | 313/584 |
| 2002/0135303 | A1 * | 9/2002 | Hashimoto | 313/582 |
| 2002/0140365 | A1 * | 10/2002 | Kobayashi | 315/169.3 |
| 2004/0145315 | A1 * | 7/2004 | Lin et al. | 313/584 |
| 2005/0231114 | A1 * | 10/2005 | Mizuta | 313/582 |

FOREIGN PATENT DOCUMENTS

| | | |
|---|---|---|
| EP | 1093148 A1 | 4/2001 |
| JP | 7-320644 | 8/1995 |
| JP | 11-86739 | 3/1999 |
| JP | 2001-110324 | 4/2001 |
| JP | 2004-71219 | 4/2004 |
| KR | 2000-0015444 | 3/2000 |
| KR | 2000-0061881 | 10/2000 |
| KR | 2003-0071042 | 9/2003 |

* cited by examiner

*Primary Examiner*—Bumsuk Won
(74) *Attorney, Agent, or Firm*—Antonelli, Terry, Stout & Kraus, LLP.

(57) ABSTRACT

A plasma display panel includes a plurality of first bus electrodes and a plurality of second bus electrodes disposed so as to be adjacent on at least one side, a plurality of first discharge electrodes and a plurality of second discharge electrodes that are transparent and extend in a comb-tooth shape in a direction perpendicular to the bus electrodes, a plurality of third electrodes extending in parallel in a vertical direction, and a plurality of horizontal barrier ribs extending in parallel to the third electrodes. Display cells are formed in portions where the first and second bus electrodes face each other and which are defined by the barrier ribs in a horizontal direction. The first discharge electrodes and the second discharge electrodes are alternately disposed for every two cells in the horizontal direction so as to protrude from the first and second bus electrodes, respectively. In each display cell, the first and second discharge electrodes have edges extending in an approximately vertical direction. A gap between the edges of the first and second discharge electrodes is gradually varied.

12 Claims, 25 Drawing Sheets

PLASMA DISPLAY PANEL AND PLASMA DISPLAY APPARATUS

CROSS-REFERENCE TO RELATED APPLICATION

The present application claims priority from Japanese patent application No. JP 2004-345575 filed on Nov. 30, 2004 and No. 2005-300008 filed on Oct. 14, 2005, the contents of which are hereby incorporated by reference into this application.

BACKGROUND OF THE INVENTION

The present invention relates to an AC plasma display apparatus (PDP apparatus) used in a display unit such as a personal computer or work station, a flat television, or a plasma display (PDP) for displaying advertisements, and information, etc.

One of commercially-available AC color PDPs is a three-electrode-type PDP in which a plurality of first electrodes and a plurality of second electrodes extending in a first direction are alternately provided in parallel and a plurality of third electrodes extending in a second direction perpendicular to the first direction are provided in parallel.

In a general structure of the three-electrode type PDP, first (X) electrodes and second (Y) electrodes are alternately provided in parallel on a first substrate, third (address) electrodes extending in the direction perpendicular to the first and second electrodes are provided on a second substrate facing the first substrate, and each surface of the electrodes is covered with a dielectric layer. Between the third electrodes on the second substrate, there are further provided one-directional stripe-shaped barrier ribs extending in parallel with the third electrodes or a two-dimensional grid-shaped barrier rib arranged in parallel with the third electrodes and the first and second electrodes so that the cells are separated from one another. After phosphor layers are formed between the barrier ribs, the first and second substrates are bonded together.

After the charges (wall charges) in the vicinity of the electrode in each cell are brought into a uniform state by applying a voltage between the first and second electrodes, a scan pulse is sequentially applied to the second electrode and an address pulse is applied to the third electrode in synchronization with the scan pulse and an addressing operation is performed to selectively leave the wall charges in the cell to be turned on. Then, by applying a sustain discharge pulse by which the two adjacent electrodes to be discharged become electrodes having alternately opposite polarities to perform the addressing operation, the cell to be turned on, in which the wall charges are left, makes a sustain discharge and is turned on. The phosphor layer emits light by the ultraviolet rays generated by the discharge, and the emitted light is seen through the first substrate. For this purpose, the first and second electrodes are each composed of an opaque bus electrode made of a metal material and a transparent electrode (discharge electrode) such as an ITO film, and the light generated in the phosphor layer is seen through the transparent electrode. Specifically, a plurality of first bus electrodes and a plurality of second bus electrodes extending parallel in a first direction are alternately disposed, and transparent first and second discharge electrodes are provided between the first and second bus electrodes facing each other. The first discharge electrode is electrically connected to the first bus electrode, whilst the second discharge electrode is electrically connected to the second bus electrode. The first and second discharge electrodes may be solid electrodes parallel to the first and second bus electrodes or may have shapes protruding from the first and second bus electrodes. In the first and second discharge electrodes protruding from the first and second bus electrodes for each display cell, edges of these electrodes facing each other are parallel to the first direction and form a parallel slit with constant width (slit width), whereby the discharge occurs across the slit. This slit is hereinafter also referred to as a "discharge slit".

Although the parallel discharge slit having a straight-line shape as described above is generally used, it is proposed that the discharge slits are formed into various shapes. For example, Japanese Patent Laid-Open Publication No. 2004-71219 ("Patent Document 1") discloses a shape in which the slit width is gradually varied in each cell. Thereby, high luminance can be obtained without increasing discharge voltage, and uniform discharge can be obtained at every cell.

In a color PDP, phosphor layers with three colors, R, G, and B are provided on three display cells adjacent to one another in the first direction so as to be distinguished respectively. By these three RGB display cells, one color pixel is formed. In view of display quality, it is desirable that color pixels be arranged with approximately the same pitch on a display screen. In each RGB display cell, width (length) of the first direction in which the first and second bus electrodes extend and width (length) of a second direction perpendicular to the first direction become approximately 1:3 ratio. That is, the display cell has an elongated shape extending in the second direction (vertical direction). Therefore, as described above, in the structure where the first and second discharge electrodes extend from the first and second bus electrodes and a discharge slit whose edges opposite to the first and second discharge electrodes are parallel to the first direction is formed, the length of the discharge slit (the length of the facing edges) is short. Therefore, there is the problem in which a discharge region is narrow and sufficient luminance cannot be obtained. Also, there is another problem in which the length of the discharge slit is shorter as the cell is smaller, whereby the discharge voltage is increased.

Japanese Patent Laid-Open Publication No. 7-320644 ("Patent Document 2"), No. 11-86739 ("Patent Document 3"), and No. 2001-110324 ("Patent Document 4") disclose an electrode shape in which: the first and second discharge electrodes alternately extend like teeth of a comb from the first and second bus electrodes, respectively, and are opposite to the edges extending in the second direction perpendicular to the first direction in which the first and second bus electrodes extend; and the discharge slit extending in the second direction (vertical direction) is formed. FIG. 1 is a view showing a conventional example of the electrode shape in which the vertical discharge slit disclosed in the Patent Document 2 is formed. As shown in FIG. 1, first (sustain) electrodes 102 and second (scan) electrodes 101 are formed like the teeth of a comb. Third (address) electrodes 103 are provided so as to overlap with portions of the second electrodes 101 extending in the second direction. The address discharges occur in portions shown by reference symbol "W". For the charges to be accumulated by the address discharges, the sustain (display) discharges are spread in regions shown by reference symbol "S". Note that the Patent Document 2 does not describe, for example, that the bus electrodes are formed by metal layers and transparent electrodes are formed by ITO films. Also, in the Patent Document 2, the first and second electrodes 102 and 101 are close to each other even in the slit that does not discharge, so that there are the problem in which power required in applying the voltage to the panel is increased.

According to the above-mentioned electrode shape (the shape of the vertical discharge slit extending in the second direction), the first and second discharge electrodes face each other over an entire region of the vertically-extending display cell and at the short distance via the discharge slit. Therefore, the voltage for sustaining the discharge can be reduced, so that the discharging region becomes wide and the high luminance is obtained.

To form the vertically-extending discharge slit in the second direction described above, the first discharge electrode and the second discharge electrode have to be extended so as to be spaced a predetermined distance apart from each other in the vertically-extending display cell. Therefore, the shapes of the first and second discharge electrodes become extremely elongated, whereby there is the problem such that disconnection occurs easily. To solve this problem, the above-mentioned Patent Document 2 discloses a structure in which the first and second discharge electrodes are integrally formed with those of the adjacent respective display cells, namely, the discharge electrodes are shared between the adjacent display cells. This structure makes it possible to widen the electrode width and reduce the occurrence of the disconnection.

Also, as described above, the commercially-available conventional AC color PDP mainly has a structure in which two electrodes (X, Y) causing repetitive discharges (sustain discharges) are each constituted by a transparent electrode (discharge electrode) and a metal electrode with a low resistance value (bus electrode) and a gap between these two electrodes (X, Y) for discharge (discharge slit) is approximately parallel to a direction in which the metal electrode extends (first direction). Meanwhile, in the PDP, a square pixel is divided into three portions in the direction in which the metal electrode extends (first direction), and these portions are assigned to cells of three colors, R, G, and B, respectively. Therefore, in one cell, the length (the first-directional distance) of the facing edges of the two electrodes (X, Y) becomes short. Note that the square pixel is a pixel, which is composed of three cells of R, G, and B and has an approximately square shape when viewed from a direction perpendicular to the PDP surface. As the PDP is more finely fabricated, the above tendency becomes more apparent. For this reason, there is proposed the structure (the above-mentioned vertically-extending discharge slit) in which the transparent electrode is drawn to a direction (second direction) perpendicular to the direction in which the metal electrode extends (first direction) and the slit between the two electrodes (X, Y) is provided so as to extend in a direction (second direction) approximately perpendicular to the metal electrode. Such a technique is described in Japanese Patent No. 3144987 ("Patent Document 6").

SUMMARY OF THE INVENTION

The vertically-extending slits disclosed in the Patent Documents 2 to 4 are such that their facing edges are the straight lines parallel to one another. Therefore, if the gap (slit width) between the facing edges is changed due to manufacture error or the like, a firing voltage is also changed, so that there is the problem such that it is difficult to cause a stable discharge. In particular, if the error occurs so that the slit width is varied for each portion of the panel, for example, if the slit width is different between right and left sides, there is the problem such that the display becomes non-uniform.

Moreover, the first and second discharge electrodes are elongated transparent electrodes, so that there is the problem such that the disconnection occurs easily. Furthermore, the transparent electrode is formed of an ITO film or the like. However, if the transparent electrode is an elongated electrode with larger resistance than that of a bus electrode formed of a metal layer, it has a larger voltage drop on a side away from the first and second bus electrodes than that on a near side thereof, so that there is the problem such that no uniform discharge occurs.

As described above, the Patent Document 2 discloses the structure in which the first and second discharge electrodes are shared with the adjacent display cells. However, the problem of the voltage drops at the tips of the first and second discharge electrodes still remains. Moreover, due to manufacturing variations of the gap between the slits, a position for starting the discharge is varied in the cell, so that there is the problem of being recognized as the display non-uniformity on the entire panel.

Still further, in the manufacturing process, a first substrate on which the first and second bus electrodes and the first and second discharge electrodes, etc. are formed and a second substrate on which the third electrodes and the barrier ribs are formed are bonded together. If there is any error in bonding, however, the positions of the barrier ribs with respect to the first and second discharge electrodes are varied. In the structure disclosed in the Patent Document 2 in which the first and second discharge electrodes are shared with the adjacent display cells, if the positions of the barrier ribs with respect to the first and second discharge electrodes are shifted in the first direction, an area ratio between the first and second discharge electrodes is changed in a different direction in the adjacent cell, whereby there arises the problem such that the discharge state differs for each cell. For example, in the AC color PDP, although the display cells adjacent in the first direction are provided with the phosphor layers of three colors, R, G, and B, the problem arises such that a color balance is varied if the discharge states differ between the adjacent display cells.

Furthermore, the AC PDP apparatus is displaced by the repetitive discharge. For this reason, it is desirable to reduce power by decreasing the drive voltage in carrying out the repetitive discharges. This tendency is further required as the number of cells increases by making the display more fine (that is, as the cell width is narrower). Still further, it is desirable to improving the luminance by shortening the drive pulse with respect to the electrodes and reducing a drive time and increase the number of times of discharge. Still further, it is also desirable to improve light-emitting efficiency by reducing a difference between electrical fields created at locations within the vertically-extending discharge space and making density of charge particles in the discharge space uniform.

The present invention aims at solution of the above problems of the vertically-extending slit, and its first object is to achieve a plasma display panel in which a stable discharge is carried out at every display cell. Its second object is to achieve a plasma display panel which improves discharge's uniformity in every display cell by reducing the above occurrence of the disconnection and reducing the voltage drops at the discharge electrodes. Its third object is to achieve a plasma display panel which reduces an influence on a bonding error occurring between the first and second substrates in a manufacturing process. Its fourth object is to achieve a technique for a plasma display panel, which reduces a drive voltage by reducing the electric power in carrying out the repetitive discharges between the two electrodes and improves the luminance by shortening a drive pulse and reducing a drive time and increasing the number of discharge times, and which improves light-emitting efficiency by reducing a difference between electrical fields created at locations within the vertically-extending discharge space and making density of charge particles in the discharge space uniform.

To attain the first object described above, a plasma display panel according to a first aspect of the present invention has a structure in which the width of the vertically-extending slit, that is, a gap between the first and second discharge electrodes, in the display cell is gradually varied in a second direction (vertical direction).

If a minimum value of the gap between the first and second discharge electrodes is close to the paschen minimum defining a discharge start voltage, the discharge start voltage can be effectively reduced.

Furthermore, a gap between facing edges of the first discharge electrode and the second discharge electrode is made so as to be minimum near the center of the display cell and be increased in the second direction (vertical direction) from the vicinity of the center. With this, a discharge starts near the center of the display cell, and then spreads vertically. As such, the discharge spreads from the center of the display cell, and the discharge center position in each display cell is the same. This is desirable for display.

However, the above conditions are not meant to be restrictive. For example, if the gap is made so as to be narrower near the second bus electrode and wider near the first bus electrode, a discharge spreads similarly in each display cell, thereby achieving uniform display.

The shape of the first and second discharge electrodes varying the slit width can be variously modified. For example, at least one of the first and second discharge electrodes has a width that is varied at one end connected to the bus electrode and at the other end. In this case, if the end connected to the bus electrode is narrower in width than the other end, an area of a portion connected to the bus electrode where no discharge occurs is reduced, thereby improving discharge efficiency.

Furthermore, the first aspect in which the slit width is gradually varied can be applied also to a structure disclosed in the Patent Document 2 in which the discharge electrodes are shared between the adjacent display cells.

Next, to attain the second object described above, a plasma display panel according to a second aspect of the present invention includes a first branch bus electrode drawn in a branch shape from a first bus electrode to its facing second bus electrode in the second direction and overlappingly provided so as to electrically make contact with at least part of the first discharge electrode and a second branch bus electrode drawn in a branch shape from a second bus electrode to its facing first bus electrode in the second direction and overlappingly provided so as to electrically make contact with at least part of the second discharge electrode.

The first and second branch bus electrodes are formed of metal layers, tend not to allow a wire break to occur compared with transparent electrodes, have a small resistance, and therefore can reduce a drop in voltage. Since he first and second branch bus electrodes formed of metal layers are opaque, it is desirable that these electrodes be superposed on the barrier ribs so as not to reduce an aperture ratio. Furthermore, in general, the metal layers are in black series, whilst the barrier ribs are in white series. Therefore, by superposing the branch bus electrodes on the barrier ribs, effects can also be achieved such that reflection of external light is reduced and a contrast (light-room contrast) can be improved.

Furthermore, to attain the third object described above, in a plasma display panel according to a third aspect of the present invention, first discharge electrodes for the adjacent display cells are provided adjacently to each other across a barrier rib, and a first connect electrode is provided so as to connect these two first discharge electrodes over the barrier rib. Also, second discharge electrodes for the adjacent display cells are provided adjacently to each other across a barrier rib, and a second connect electrode is provided so as to connect these two second discharge electrodes over the barrier rib. For example, the total width of the first connect electrode and the second connect electrode in the second direction is narrower than the width of each of the first and second discharge electrodes in the second direction.

According to the third aspect of the present invention, since the first and second connect electrodes have a narrow width, even if the position of the barrier rib is displaced in the first direction, variations in area ratio between the electrodes involving a discharge can be reduced compared with the case disclosed in the Patent Document 2 where the discharge electrodes of the adjacent display cells are integrally formed.

Also, even if the structure according to the second aspect in which branch bus electrodes are provided is applied to the third aspect, similar effects can be achieved. Furthermore, the second and third aspects can be combined with the first aspect.

When the second discharge electrode is a scan electrode that causes, together with the third electrode, an address discharge defining a display cell to be lit, an area where the third electrode overlaps with the second discharge electrode is preferably larger than an area where the third electrode overlaps with the second discharge electrode, when viewed from a direction perpendicular to a display surface of the panel.

Still further, the third electrode may not overlap with the first discharge electrode when viewed from the direction perpendicular to the display surface of the panel.

To achieve the above structure, for example, the width of the third electrode is increased at a portion where the third electrode overlaps with the second discharge electrode. Also, when the first discharge electrode and the second discharge electrode are arranged on a straight line in the first direction, the gaps of the third electrodes may be alternately varied.

To achieve uniform display cells, the discharge electrodes of adjacent display cells preferably have an approximately axisymmetric shape with respect to the barrier rib. For example, however, depending on the color of the display cell, the shape of the electrodes and the shape of the slit may be changed.

A dielectric layer on the first substrate is preferably a silicon-dioxide layer with a high density formed through vapor deposition. In this case, the surface of the dielectric layer and the protective layer of the first substrate has asperities in accordance with thicknesses of the first bus electrode, the second bus electrode, the first discharge electrode, and the second discharge electrode. Through a space formed among asperities, exhaustion from a discharge space and injection of discharge gas are performed.

The first and second bus electrodes can be alternately disposed in an order such that first comes the first one, then the second one, the first one, and then the second one, or in an order such that first comes the first one, then the second one, the second one, the first one, the first one, the second one, and then the second one, where two of the first bus electrodes are adjacent to each other on one side and also two of the second bus electrodes are adjacent to each other on one side. In accordance with the arrangement of the first and second bus electrodes, the scheme of drawing the first and second discharge electrode can be variously modified. Accordingly, the scheme of disposing the third electrodes can be variously modified.

Stripe-shaped barrier ribs extending in the second direction (vertical direction) is always required to be provided. In addition, barrier ribs (second barrier ribs) extending in a first direction (horizontal direction) may be provided to form a two-dimensional barrier rib. The barrier ribs in the horizontal direction can be arranged in a manner such that a barrier rib is provided between adjacent bus electrodes or such that two barrier ribs are provided to cover the edges of the bus electrodes. When a barrier rib is provided between adjacent bus electrodes in the horizontal direction, a discharge between the adjacent bus electrodes can be suppressed, thereby making the gap between the bus electrodes narrow. Also, when the barrier ribs are provided so as to cover each of edges of the bus electrodes, the tip of the discharge electrode facing the edge can be extended to the vicinity of the barrier rib in the horizontal direction. However, if the edges are not covered by the barrier ribs in the horizontal direction, a gap between the tip of the discharge electrode and the bus electrode has to be wide so as not to cause a discharge. When a discharge occurs between the bus electrode and the discharge electrode, although no problem arises in terms of operation, light is shielded by the bus electrode, thereby wasting part of emitted light.

Still further, to attain the fourth object described above, a plasma display panel according to a fourth aspect of the present invention has the following structure, particularly regarding edges of two electrodes (first and second discharge electrodes) for discharge at each display cell, the width of the above vertically-extending discharge slit (=a distance between discharge electrode edges), and others. For each cell, a ratio of the width (d2) of the discharge electrode to the width (d1) of the discharge slit in the first direction corresponding to the slit is made smaller than 1 (d2/d1<1), that is, d1>d2. In other words, in the first direction in an area corresponding to the discharge space in each display cell, a relation between the gap (d1) of the slit and the width (d2) of the first and second discharge electrodes positioned on both sides of the slit (however, the width that corresponds to the inside of the cell) is made such that d1 is larger than one-third of the cell breadth area (M) and d2 is smaller than one-third of the cell breadth. The shape of the discharge electrodes is assumed to be, for example, an vertically-extending rectangle with its edges being formed of straight lines.

Here, d1 represents a distance from an edge of one of the two discharge electrodes (X and Y discharge electrode) to an edge of the other of those two discharge electrodes (X and Y discharge electrodes). Also, d2 represents a distance from an edge of one (for example, Y) of the discharge electrodes on a slit side to an opposing edge near a cell boundary (when the discharge electrodes are separately formed between the adjacent cells), or to a position divided by a barrier rib in the horizontal direction (when the discharge electrodes are shared and integrated between the adjacent cells). The position divided by the barrier rib (one end of "d2") corresponds to, for example, an end of a side surface of the cell of a top surface of the barrier rib in the vertical direction (on a side of making contact with the asperities on the surface of the dielectric layer and the protective layer on the first substrate side), in other words, a position on a top end of the side surface of the cell That is, the plasma display panel according to the fourth aspect has a group of first metal electrodes and a group of second metal electrodes disposed approximately in parallel on a first substrate; a group of transparent electrodes drawing from the metal electrodes in a direction (second direction) approximately perpendicular to an extending direction (first direction) of the metal electrodes; a dielectric layer and a protective layer covering the two groups of the metal electrodes; a group of third electrodes disposed on a second substrate facing the first substrate and extending in the second direction; barrier ribs approximately in parallel with the group of the third electrodes for division of pixels (display cells) in the first direction; and a phosphor layer applied to the barrier ribs and between the barrier ribs. The transparent electrodes drawn from the first and second metal electrodes face each other across a gap (slit) extending in the second direction. A distance of the gap in the first direction is wider than the width of the transparent electrode in a cell. With this, a difference in electric field in the discharge space can be reduced.

Still further, the above-described first to fourth aspects of the present invention can be applied to, for example, ALIS PDPs disclosed in Japanese Patent No. 2801893 ("Patent Document 5").

According to the present invention, a plasma display panel in which uniform discharge occurs at all display cells can be manufactured with increased yields. Thus, a high-quality plasma display panel can be achieved at low cost.

DESCRIPTION OF THE PREFERRED EMBODIMENTS

Figure 1:
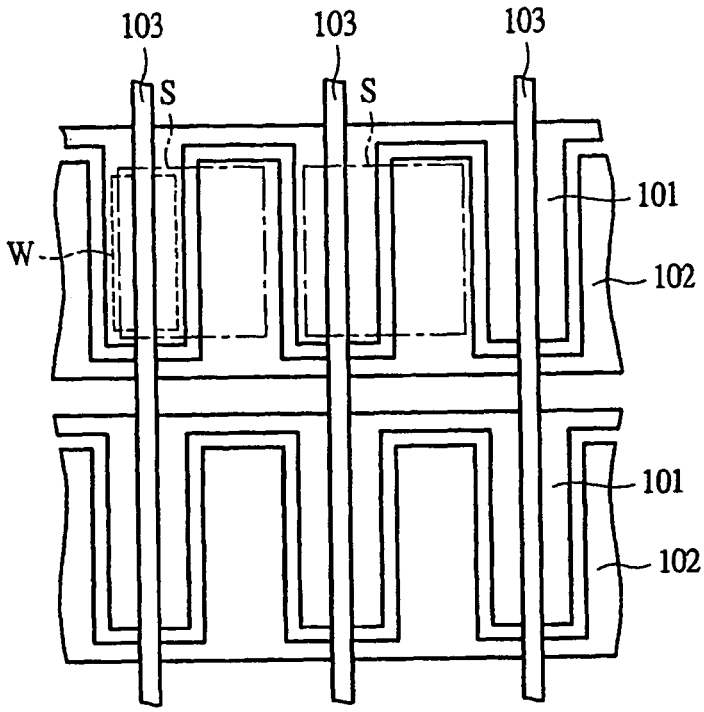
FIG. 1 is a view showing a conventional example of vertical-directional discharge slits.
Figure 2:
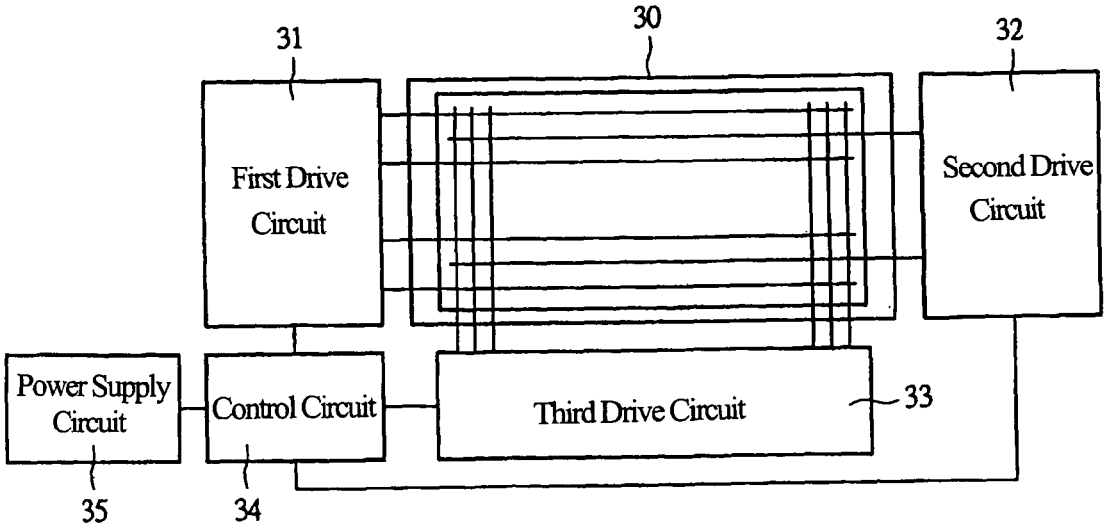
FIG. 2 is a view showing an entire structure of a PDP apparatus according to a first embodiment of the present invention.

FIG. 2 is a view showing an entire structure of a plasma display apparatus (PDP apparatus) according to a first embodiment of the present invention. As shown, a plasma display panel 30 has a group of first electrodes (X electrodes) and a group of second electrodes (Y electrodes) extending in a horizontal direction (longitudinal direction), and a group of third electrodes (address electrodes) extending in a vertical direction. The X electrodes and the Y electrodes are alternately disposed, and one X electrode and one Y electrode form a pair. The X electrodes are connected to a first drive circuit 31 and are driven in common. The Y electrodes are connected to a second drive circuit 32, which sequentially applies a scan pulse to the Y electrodes, and are driven in common except for when applying the scan pulse. The address electrodes are connected to a third drive circuit 33, which independently applies an address pulse to the address electrodes in synchronization with the scan pulse. The first to third drive circuits 31 to 33 are controlled by a control circuit 34, and power from a power supply circuit 35 is supplied to the respective drive circuits.

Figure 3:
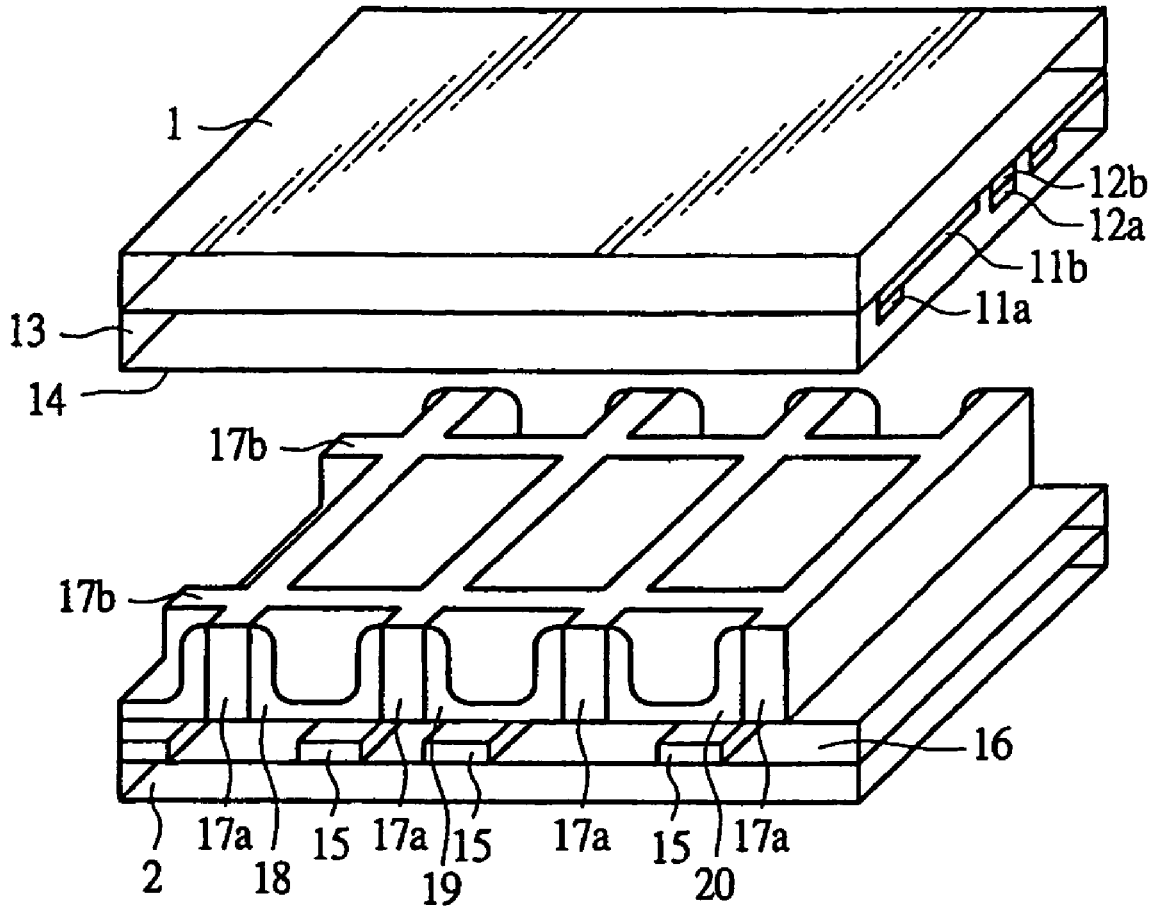
FIG. 3 is an exploded perspective view of a PDP according to the first embodiment.

FIG. 3 is an exploded perspective view of the plasma display panel (PDP) 30. As shown, on a front (first) glass substrate 1, first (X) bus electrodes 11*a* and second (Y) bus electrodes 12*a* are alternately disposed parallel so as to extend in a first direction (horizontal direction). X and Y optical transparent electrodes (discharge electrodes) 11*b* and 12*b* are provided so as to overlap with the X and Y bus electrodes 11*a* and 12*a*, respectively. Further, a portion of each of the X and Y discharge electrodes 11*b* and 12*b* protrudes from the X and Y bus electrodes 11*a* and 12*a*, respectively, to a counterpart bus electrode that forms a pair. For example, the X and Y bus electrodes 11*a* and 12 are formed of metal layers, whilst the discharge electrodes 11*b* and 12*b* are formed of ITO layer films or the like. The X and Y bus electrodes 11*a* and 12*a* have resistance values equal to or lower than those of the discharge electrodes 11*b* and 12*b*. Note that an ITO layer film, which is the same material as those of the discharge electrodes 11*b* and 12*b*, may be interposed between the front (first) glass substrate 1 and the X and Y bus electrodes 11*a* and 12*a*.

Above the discharge electrodes 11*b* and 12*b* and the bus electrodes 11*a* and 12*a*, a dielectric layer 13 is formed so as to cover these electrodes. This dielectric layer 13 is made of, for example, $SiO_2$ allowing visible light to pass through, and is formed through a vapor deposition scheme. Note that, of the vapor deposition schemes of forming the dielectric layer 13, a CVD method, particularly, a plasma CVD method is suitable and the thickness of the dielectric layer 13 can be made equal to or lower than approximately 10 μm.

Furthermore, on the dielectric layer 13, a protective layer 14 made of MgO or the like is formed. This protective layer 14 has effects of, for example, discharging electrons through ion bombardment to grow a discharge, thereby reducing a discharge voltage and a discharge delay. In this structure, since all electrodes are covered with this protective layer 14, a discharge using the effects of the protective layer is possible even if any one of the electrode groups act as a cathode.

Meanwhile, on a back (second) substrate 2, third (address) electrodes 15 are disposed approximately parallel so as to extend in a second direction (vertical direction) approximately perpendicular to the first direction. The address electrodes 15 are formed of, for example, metal layers. Furthermore, a dielectric layer 16 is formed so as to cover the address electrodes 15.

On the dielectric layer 16, a two-dimensional grid-shaped barrier rib 17 composed of vertical-direction barrier ribs 17*a* and horizontal-direction barrier ribs 17*b* is formed. On side and bottom surfaces of grooves formed by the barrier rib 17 and the dielectric layer 16, phosphor layers 18, 19 and 20, which are excited by ultraviolet light occurring at discharge to emit visible light of red, green, and yellow, are applied. The phosphor layers 18, 19, and 20 emit light of, for example, red (R), green (G), and blue (B), respectively.

The first and second substrates 1 and 2 described above are bonded together, air therebetween is exhausted, and discharge gas such as neon (Ne)-xenon (Xe) is injected and sealed, thereby completing the panel.

Figure 4:
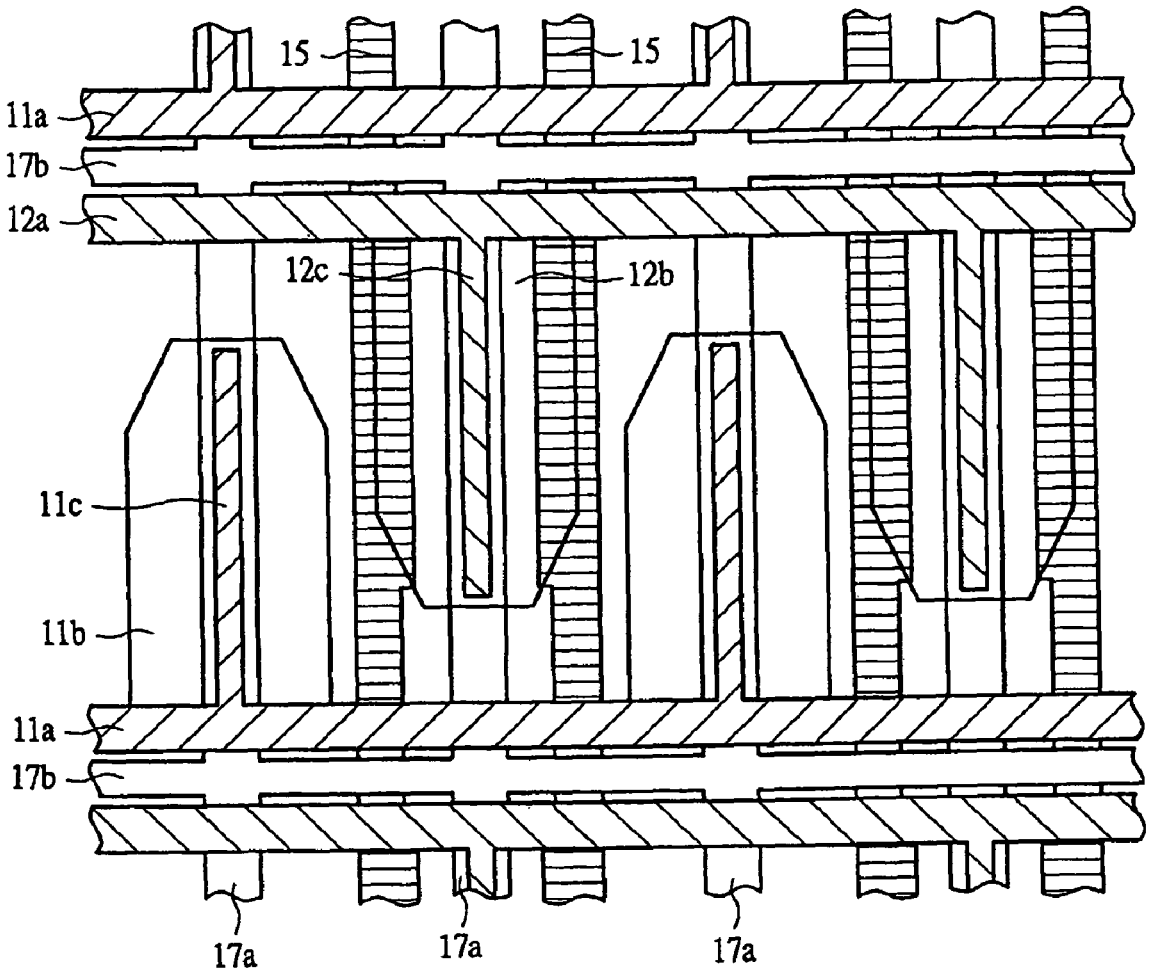
FIG. 4 is a view showing an electrode shape according to the first embodiment.

FIG. 4 is a partial plan view showing the electrode shape of the PDP according to the first embodiment. As shown, the X bus electrodes 11*a* and the Y bus electrodes 12*a* are alternately disposed parallel, and respective ones of the X bus electrodes 11*a* and the Y bus electrodes 12*a* form a pair. Between the X bus electrode 11*a* and the Y bus electrode 12*a*, the horizontal barrier rib 17*b* is provided in a direction approximately perpendicular to the vertical barrier rib 17*a*. Note that, in the Figure, the horizontal barrier rib 17*b* does not overlap with the X bus electrode 11*a* and the Y bus electrode 12*a*. Alternatively, a portion or both of the X bus electrode 11*a* and the Y bus electrode 12*a* may be overlaid on the horizontal barrier rib 17*b*. A section defined by the vertical barrier rib 17*a* and the horizontal barrier rib 17*b* is a display cell. Therefore, in the Figure, each display cell has the Y bus electrode 12*a* on its upper side and the X bus electrode 11*a* on its lower side. Also, X branch bus electrodes 11*c* extend from the X bus electrode 11*a* so as to overlap with every other vertical barrier rib 17*a*. Also, Y branch bus electrodes 12*c* extend from the Y bus electrode 12*a* so as to overlap with every other vertical barrier rib 17*a* not overlapping with the X branch bus electrodes 11*c*. In other words, if the X branch bus electrodes 11*c* are provided so as to overlap with the odd-numbered vertical barrier ribs 17*a*, the Y branch bus electrodes 12*c* are provided so as to overlap with the even-numbered vertical barrier ribs 17*a*. The X branch bus electrodes 11*c* and the Y branch bus electrodes 12*c* are formed of metal layers and integrally with the X bus electrode 11*a* and the Y bus electrode 12*a*

The X discharge electrodes 11*b* protrude like teeth of a comb from the X bus electrode 11*a* to the Y bus electrode 12*a*, whilst the Y discharge electrodes 12*b* protrude like teeth of a comb from the Y bus electrode 12*a* to the X bus electrode 11*a* forming a pair therewith. Each X discharge electrode 11*b* extends from and to both sides of the relevant X branch bus electrode 11*c*. Similarly, each Y discharge electrode 12*b* extends from and to both sides of the relevant Y branch bus electrode 12*c*. The X discharge electrodes 11*b* and the Y discharge electrodes 12*b* are transparent electrodes. Each X discharge electrode 11*b* is provided so as to electrically contact with the X bus electrode 11*a* and the X branch bus electrode 11*c*, whilst each Y discharge electrode 12*b* is provided so as to electrically contact with the Y bus electrode 12*a* and the Y branch bus electrode 12*c*.

Figure 5:
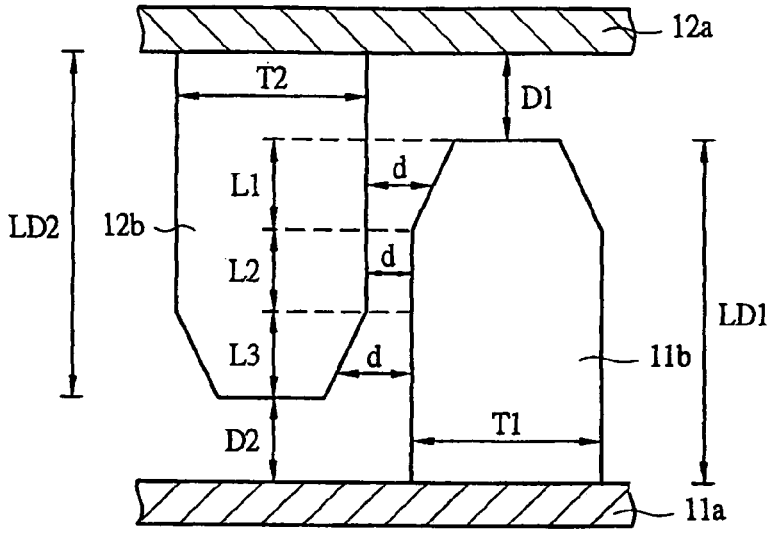
FIG. 5 is a view for explaining details and effects of the electrode shape according to the first embodiment.

FIG. 5 is a view showing the details of the electrode shape according to the first embodiment. As shown, a distance D1 between a tip of the X discharge electrode 11*b* and the Y bus electrode 12*a* is shorter than a distance LD2 from the Y bus electrode 12*a* to the tip of the Y discharge electrode 12*b*. Similarly, a distance D2 between the tip of the Y discharge electrode 12*b* and the X bus electrode 11*a* is shorter than a distance LD1 from the X bus electrode 11*a* to the tip of the X discharge electrode 11*b*. Therefore, the X discharge electrode 11*b* and the Y discharge electrode 12*b* formed into comb-teeth shapes extend closely to each other's side. Also, the X discharge electrode 11*b* and the Y discharge electrode 12*b* have a width T1 on a side of the X bus electrode 11*a* and a width T2 on a side of the Y bus electrode 12*a*, respectively, and are gradually tapered at a portion close to their tips, which is parallel to the X bus electrode 11*a* and the Y bus electrode 12*a*, respectively. Therefore, the facing edges of the X discharge electrode 11*b* and the Y discharge electrode 12*b* have a gap "d" therebetween, which is constant in a region shown by reference symbol "L2" and is gradually increased externally from the edges in regions denoted by reference symbols "L1" and "L3" on both sides thereof.

A minimum value of the gap (a value of the gap "d" in the region L2) is set so as to be close to a paschen minimum defining a firing voltage. The distance D1 between the tip of the X discharge electrode 11*b* and the Y bus electrode 12*a* and the distance D2 between the tip of the Y discharge electrode 12*b* and the X bus electrode 11*a* desirably have values so as not to start the discharge. Therefore, the distances D1 and D2 are desirably larger than the maximum value of the gap "d" between the facing edges of the X discharge electrode 11*b* and the Y discharge electrode 12*b*. This is because a portion of light emission through the discharge between a discharge electrode and a bus electrode is prevented from being shielded by the bus electrode serving as a metal layer and from going to waste. Note that if the horizontal barrier rib 17*b* is extended to the edges of the X and Y bus electrodes 11*a* and 12*a* facing the X and Y discharge electrodes 11*b* and 12*b*, a discharge at that portion can be prevented, so that the distances D1 and D2 can be further decreased. In this case, the distances D1 and D2 can be equal to or shorter than the gap "d" between the facing edges of the X discharge electrode 11*b* and the Y discharge electrode 12*b*.

In the electrode shape of FIG. 5, the discharge between the X discharge electrode 11*b* and the Y discharge electrode 12*b* starts at the region L2 disposed near its center, and then spreads to the regions L1 and L3 on both sides. Therefore, the discharge between the X discharge electrode 11*b* and the Y discharge electrode 12*b* always occurs centering on the display cell.

Referring back to FIG. 4, the X and Y branch bus electrodes 11*c* and 12*c* are formed of metal layers, extend near the tips of the X and Y discharge electrodes 11*b* and 12*b*, respectively, and reduce voltage drops near the tips of the X and Y discharge electrodes 11*b* and 12*b*. Also, the X and Y branch bus electrodes 11*c* and 12*c* are formed of metal layers, but are provided so as to overlap with the vertical barrier ribs 17*a*. Therefore, light is not shielded to reduce an aperture ratio. Furthermore, while the barrier ribs are mainly white to reflect external light well, the X and Y branch bus electrodes 11*c* and 12*c* reflect external light less. Thus, a light-room contrast can be improved.

Further, each address electrode 15 is disposed so as to overlap with the Y discharge electrode 12*b* but not to overlap with the X discharge electrode 11*b*. Still further, the address electrode 15 becomes widened at a portion overlapping with the Y discharge electrode 12*b* so that an area overlapping with the Y discharge electrode 12*b* becomes large. Therefore, the address electrodes 15 are disposed alternately at narrow gaps and wide gaps. As described further below, an address discharge defining a display cell to emit light is performed between a Y discharge electrode and an address electrode. Therefore, with the above-described structure, the address discharge can be reliably caused to occur and the probability of occurrence of the address discharges can be improved. Also, since the X discharge electrode 11*a* and the address electrode 15 do not overlap with each other, a capacitance therebetween is reduced, thereby making it possible to be driven easily.

Figure 6:
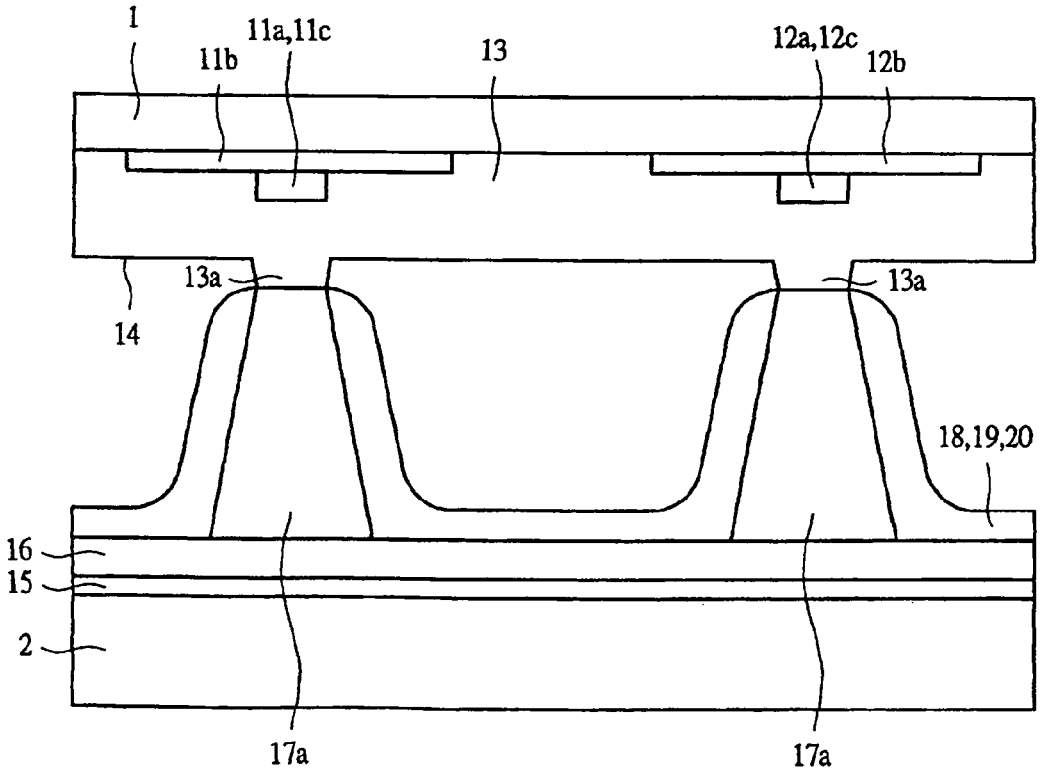
FIG. 6 is a sectional view of the PDP according to the first embodiment.

FIG. 6 is a sectional view of the PDP according to the first embodiment. As shown, an ITO film corresponding to the X and Y discharge electrodes 11*b* and 12*b* is formed on the substrate 1. This ITO film is also formed on portions of the X and Y bus electrodes 11*a* and 12*a*. Above the ITO film, a metal layer is formed on portions corresponding to the X and Y bus electrodes 11*a* and 12*a* and the X and Y branch bus electrodes 11*c* and 12*c*. Then, a dielectric layer 13 is further formed, on which a protective layer 14 made of MgO or the like is formed. If the dielectric layer 13 is formed through a vapor deposition method with silicon dioxide, the dielectric layer 13 have asperities on its surface correspondingly to thicknesses of the metal layer and the ITO film. Therefore, at a portion formed with the metal layer, the thickness is represented by an accumulation of the ITO film, the metal layer, the dielectric layer, and the protective layer 14. At an ITO film portion not formed with a metal layer, the thickness is represented by an accumulation of the ITO film, the dielectric layer 13, and the protective layer 14. At a portion not formed with a metal layer or an ITO film, the thickness is represented by an accumulation of the dielectric layer 13 and the protective layer 14. A portion formed with the metal layers corresponding to the X and Y branch bus electrodes 11*c* and 12*c* is the thickest, which is positioned at the vertical barrier ribs 17*a*, thereby preventing charge interference in a horizontal direction. The thickest portion is intermitted between the tips of the X and Y branch bus electrodes 11*c* and 12*c* and the X and Y bus electrodes 11*a* and 12*a*, and a gap is formed between the intermitted portion and the vertical barrier rib 17*a*. This gap is formed alternately on the upper side (side of the Y bus electrode 12*a*) and the lower side (side of the X bus electrode 11*a*) of the display cells arranged in the horizontal direction. The gap can be used as a route for exhausting air from the discharge gap and a route for filling discharge gas.

Figure 7:
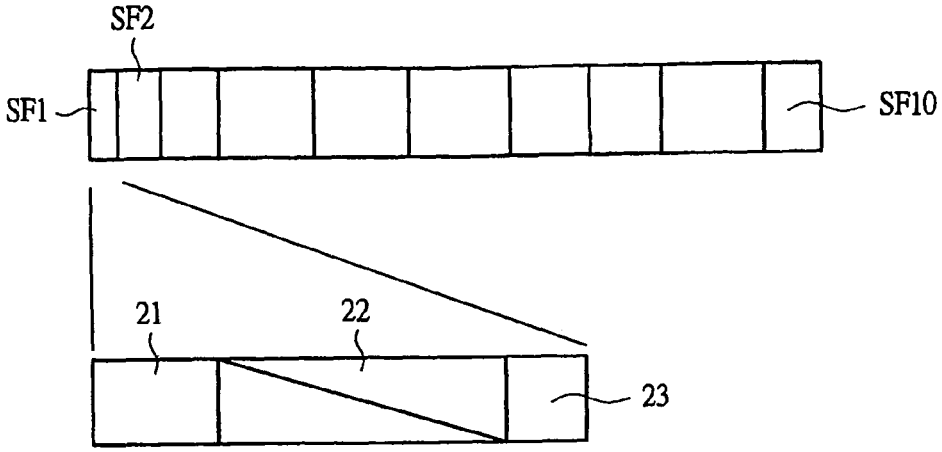
FIG. 7 is a view showing a configuration of a subfield of the PDP apparatus according to the first embodiment.

Next, a method of driving the PDP apparatus according to the first embodiment will be described. The PDP apparatus according to the first embodiment uses a driving method similar to that in the conventional technique. FIG. 7 is a view showing a structure of a subfield in displaying one image (one field: 1/60 sec) in the PDP apparatus according to the first embodiment. Only turning on or off each cell in the PDP can be selected, whereby the lighting luminance is varied, that is, a gray scale cannot be displayed. Therefore, one field is divided into a plurality of subfields with predetermined weights, and each cell is combined with subfields to be turned on in one field, thereby displaying a gray scale. Each subfield normally has the same drive sequence. Herein, an address/display separation scheme, which has been widely adopted in current PDP apparatuses, is used.

As shown in FIG. 7, one filed is composed of a plurality of subfields (herein, 10 subfields from SF1 to SF10). Each subfiled is formed of a reset period 21, an address period 22, and a sustain period 23. If the number of sustain pulses during the sustain period 23, that is, a sustain cycle is constant, the luminance weight of each subfield is determined by an interval of the sustain period 23. Gray-scale display of each display cell is performed by combining the subfields to be turned on in one field. Note that an operation of deleting a wall discharge formed in the sustain period may be included in the sustain period 23, or may be included in the next reset period 21. Herein, such an operation is assumed to be included in the end of the sustain period 23.

In the reset period 21, an operation is performed to make charges in all display cells uniform so as to assist a discharge in the next address period 22. In the address period 22, an address discharge determining a display cell to be turned on is performed. For the address discharge, there are a scheme of forming a charge in a light-emitting cell and a scheme of deleting a charge in a non-light-emitting cell. Here, the scheme of forming a charge in a light-emitting cell is used. In the sustain period 23, a discharge is repeatedly caused to occur in the display cells to be selected in the address period 22, thereby causing the display cells to emit light. Then, with a sustain discharge, the formed charge is deleted.

Figure 8:
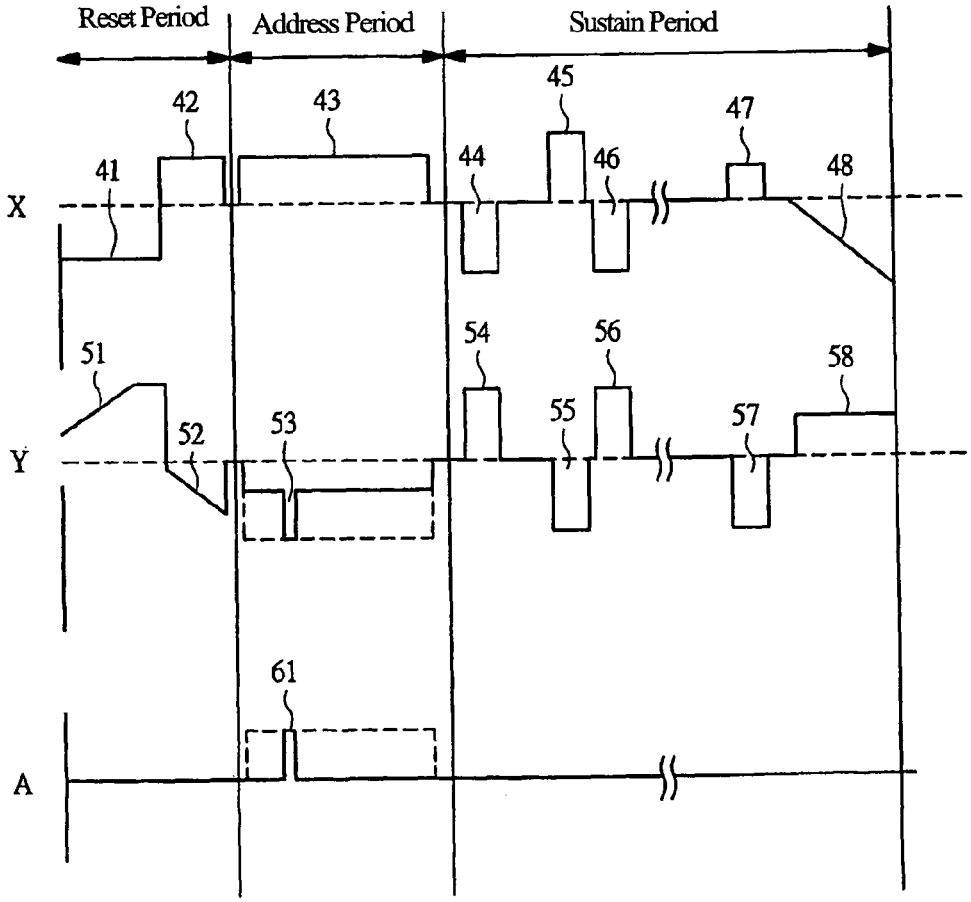
FIG. 8 is a view showing drive waveforms of the PDP apparatus according to the first embodiment.

FIG. 8 is a view showing drive waveforms in one subfield according to the first embodiment. In the Figure, the reference symbols "X", "Y", and "A" represent drive waveforms applied to the X bus electrode 11*a*, the Y bus electrode 12*a*, and the address electrode 15. Similar drive waveforms are applied to the X discharge electrode 11*b* and the X branch bus electrode 11*c*, and the Y discharge electrode 12*b* and the Y branch bus electrode 12*c* from the X bus electrode 11*a* and the Y bus electrode 12*a*.

First, in the reset period, a reset voltage 41 is applied to the X electrode and a write dull wave 51 is applied to the Y electrode, thereby causing a reset discharge to occur in all display cells. With this, a wall discharge is formed near the electrodes. Then, an adjustment voltage 42 is applied to the X electrode and the adjustment dull wave 52 is applied to the Y electrode, thereby reducing the amount of the formed wall discharge to a predetermined amount. With this, a uniform discharge is ready for all display cells irrespectively of the lighting state of the previous subfield. In the reset period, 0 V is applied to the address electrode.

In the address period, with a predetermined voltage 43 being applied to the X electrode, a scan pulse 53 is applied sequentially to the Y electrode with a shifted timing. In response to the scan pulse 53, an address pulse 61 is applied to the address electrode. With this, a discharge occurs from the Y discharge electrode and the address electrode of a display cell in a row (Y bus electrode) applied with the scan pulse 53 and a column (address electrode) applied with the address pulse 61. At this time, a large field occurs between the Y electrode and the X electrode. With a discharge between the Y discharge electrode and the address electrode as a trigger, a discharge occurs between the Y discharge electrode and the X discharge electrode. With this discharge, charges having a polarity in reverse to the polarity of the voltage applied to each electrode are accumulated near the Y discharge electrode and the X discharge electrode. Here, a wall charge having a positive polarity is formed near the Y electrode, whilst a wall charge having a negative polarity is formed near the X electrode. As such, lighting cells are selected on the entire display surface.

In the next sustain period, first sustain pulses 44 and 54 are applied to the X and Y electrodes, respectively. With this, a voltage by the wall charge is superposed at the discharge cells where an address discharge occurred in the address period, thereby causing a sustain discharge for the first time. With this sustain discharge for the first time, the polarities of the charges accumulated near the X discharge electrode and the Y discharge electrode are reversed. Next, pulses 45 and 55 for matching the polarity of the charges are applied, thereby causing a sustain discharge for the second time. Also at this time, the polarities of the wall charges are reversed. Then, sustain pulses 46 and 56 are repeatedly applied with their polarities reversed each time, sustain discharges are repeatedly caused to occur with the polarities of the wall charges repeatedly reversed. To end the sustain period, on-cell delete pulses 47 and 57 are applied to the X and Y electrodes, respectively, to delete or reduce the wall charges only at the display cell where sustain discharges have occurred. When these on-cell delete pulses 47 and 57 are applied, a potential difference between the X discharge electrode and the Y discharge electrode is smaller than that at the time of sustain, and a discharge occurs mainly due to the wall charges. When the amount of wall charges is reduced by the discharges, the occurrence of discharges stops, and the amount of wall charges formed after discharge is small. With this, the wall charges formed by the sustain discharges can be deleted or reduced. Thereafter, modified pulses 48 and 58 are applied to the X and Y electrodes, respectively, and if a large amount of wall charges remains, a weak delete discharge is cause to occur to reduce the wall charges. In the next subfield, a reset period comes back again. Here, during the sustain period, 0 V is applied to the address electrode.

The PDP apparatus according to the first embodiment of the present invention has been described above. The shape of the electrodes, for example, can be variously modified. Modification examples of the shape of the electrodes are described below.

FIGS. 9A to 9D, 10A, 10B, and 12A to 12C are drawings of modification examples of the shape of the electrodes.

Figure 9A:
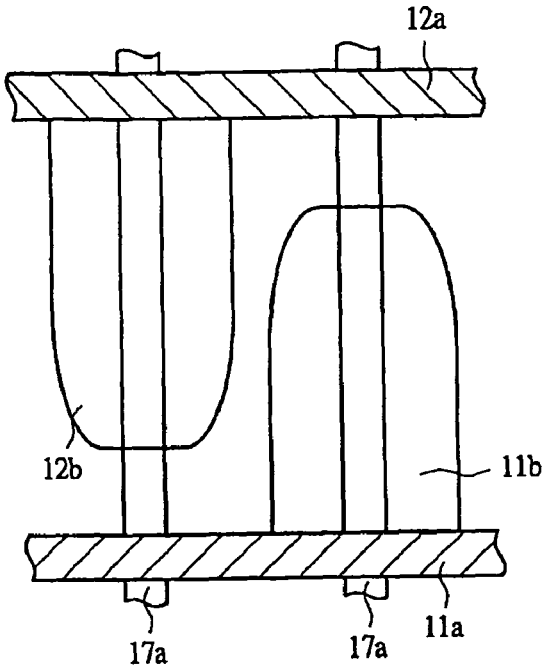
FIG. 9A is a view showing a modification example of the electrode shape according to the first embodiment.

In the shape of the electrodes shown in FIG. 9A, unlike the case in the first embodiment where the edges of the X and Y discharge electrodes 11*b* and 12*b* are formed by combining straight lines, they are formed with smoothly curved lines. Also, the X and Y branch bus electrodes 11*c* and 12*c* are removed. Even with the shape of the electrodes shown in FIG. 9A, the effects described with reference to FIG. 5 can be achieved. Here, in FIGS. 9A to 9D, address electrodes and horizontal barrier ribs are omitted.

Figure 9B:
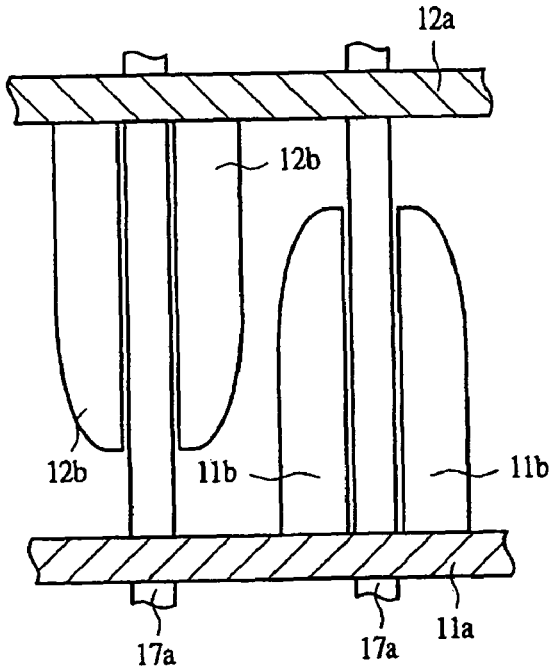
FIG. 9B is a view showing a modification example of the electrode shape according to the first embodiment.

In the shape of the electrodes shown in FIG. 9B, the X and Y discharge electrodes 11*b* and 12*b* in the shape of the electrodes shown in FIG. 9A are each separated for each display cell. Here, the X and Y discharge electrodes 11*b* and 12*b* according to the first embodiment can be each formed to be separate for each display cell. Even with the shape of the electrodes shown in FIG. 9B, the effects described with reference to FIG. 5 can be achieved. However, since the electrode is further elongated, a problem arises in which a wire break tends to occur.

Figure 9C:
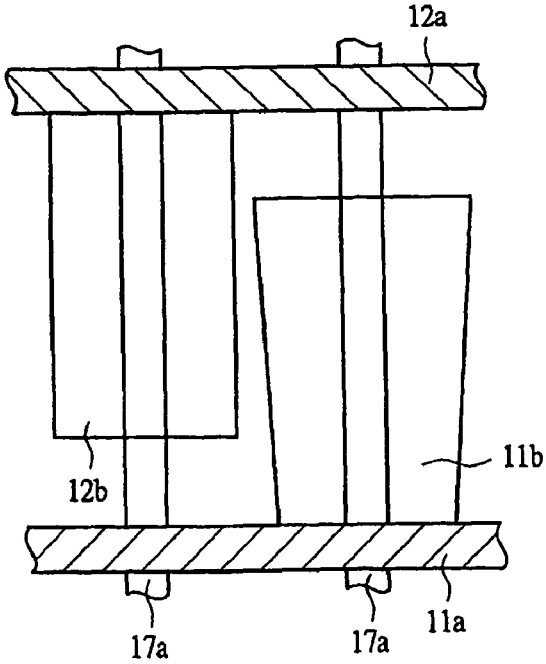
FIG. 9C is a view showing a modification example of the electrode shape according to the first embodiment.

In the shape of the electrodes shown in FIG. 9C, the X discharge electrode 11*b* is formed in a trapezoid, whilst the Y discharge electrode 12*b* is formed in a rectangle. Even with the shape of the electrodes shown in FIG. 9C, the gap between the facing edges of the X discharge electrode 11*b* and the Y discharge electrode 12*b* (slit width) is gradually varied, with the minimum width being formed at a side near the Y bus electrode 12*a*. A discharge occurs near a portion where the gap is minimum, and then spreads downward. Since the distribution of the discharge is as such described above in all display cells, uniformity in discharge among the display cells is satisfactory.

Figure 9D:
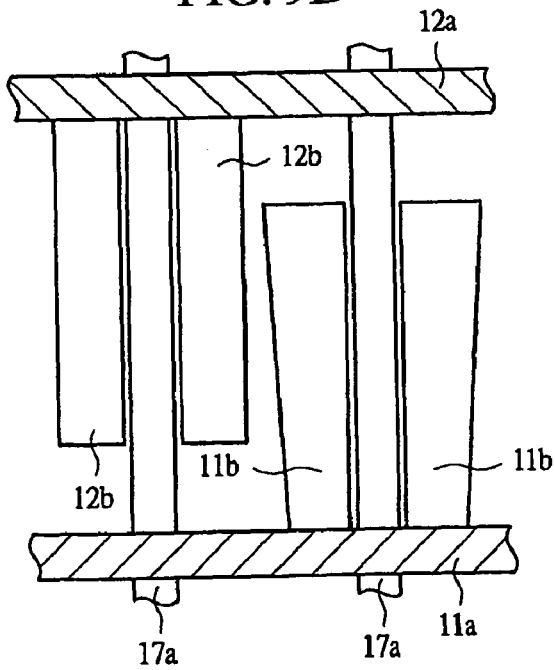
FIG. 9D is a view showing a modification example of the electrode shape according to the first embodiment.

In FIG. 9D, the X and Y discharge electrodes 11*b* and 12*b* shown in FIG. 9C are each separated for each display cell.

Figure 10A:
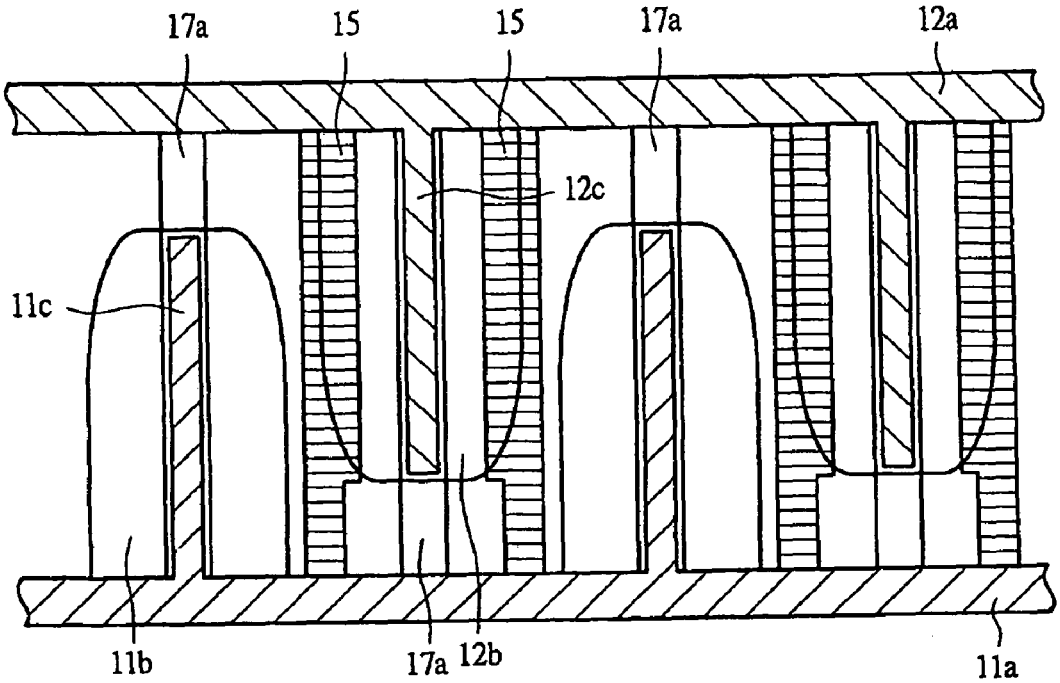
FIG. 10A is a view showing another modification example of the electrode shape according to the first embodiment.

In the shape of the electrodes shown in FIG. 10A, as described with reference to FIG. 9A, the edges of the X discharge electrode 11*b* and the Y discharge electrode 12*b* in the shape of the electrodes according to the first embodiment are exemplarily formed with smooth curved lines.

Figure 10B:
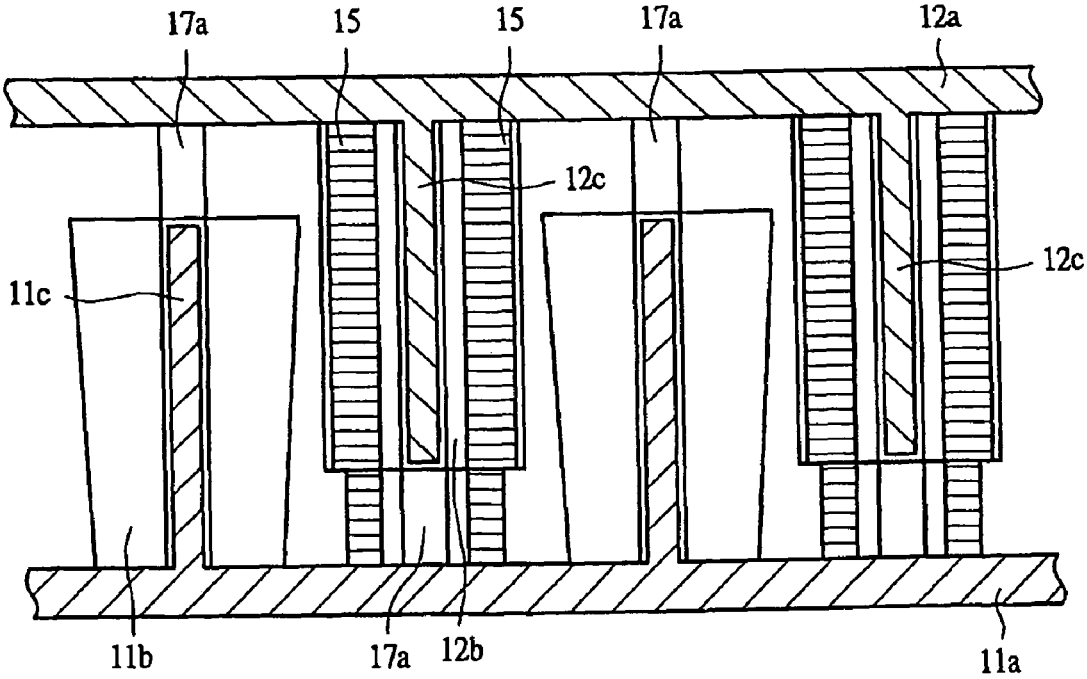
FIG. 10B is a view showing another modification example of the electrode shape according to the first embodiment.

In the shape of the electrodes shown in FIG. 10B, as described with reference to FIG. 9C, the X discharge electrode 11*b* in the shape of the electrodes according to the first embodiment is exemplarily formed in a trapezoid, whilst the Y discharge electrode 12*b* therein according to the first embodiment is formed in a rectangle.

Figure 11:
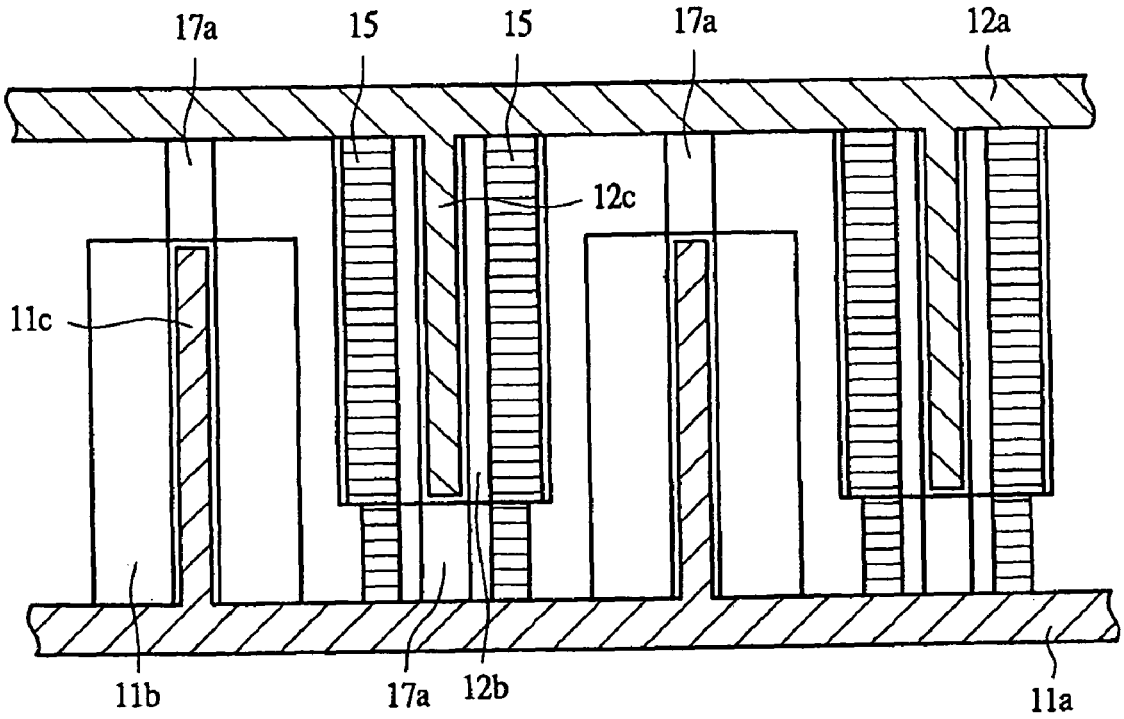
FIG. 11 is a view showing a still another modification example of the electrode shape according to the first embodiment.

In the shape of the electrodes shown in FIG. 11, the X discharge electrode 11*b* and the Y discharge electrode 12*b* in the shape of the electrodes according to the first embodiment are each exemplarily formed in a rectangle. In this example, the width of the slit formed by the X discharge electrode 11*b* and the Y discharge electrode 12*b* is constant, and therefore an effect of making the discharge distribution constant cannot be achieved. However, compared with the conventional example, the X and Y branch bus electrodes 11*c* and 12*c* are provided. Therefore, a drop in voltage at the tips of the X discharge electrode 11*b* and the Y discharge electrode 12*b* can be prevented, thereby reducing the effect of a wire break.

Figure 12A:
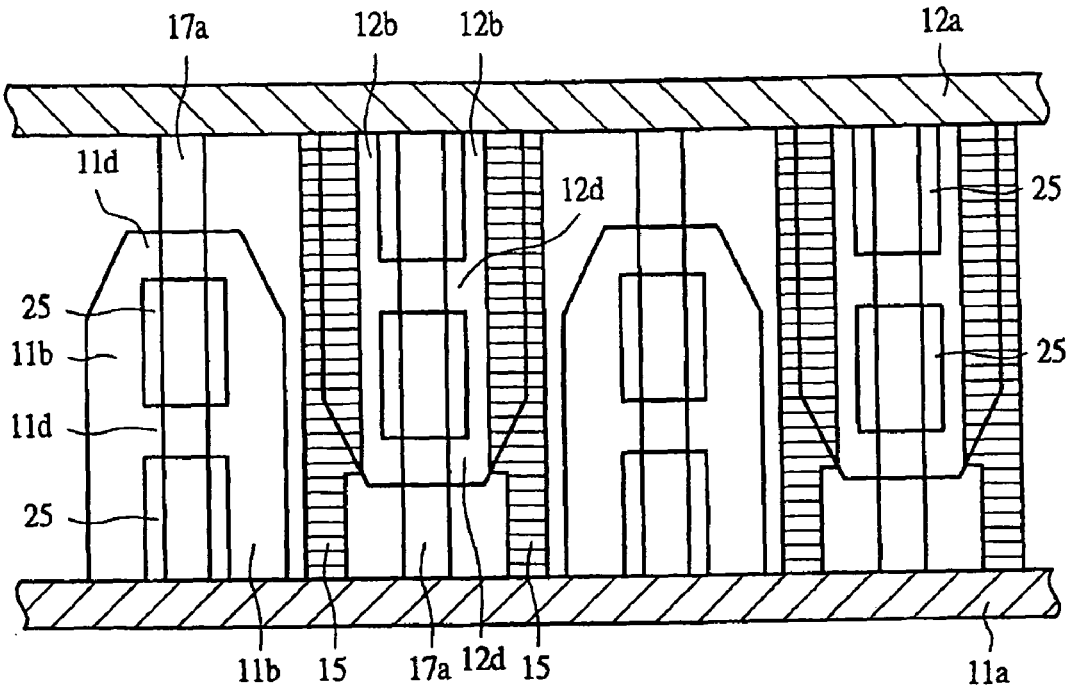
FIG. 12A is a view showing still other modification example of the electrode shape according to the first embodiment.

In the shape of the electrodes shown in FIG. 12A, the X and Y branch bus electrodes 11*c* and 12*c* in the shape of the electrodes according to the first embodiment are removed, and notches 25 are provided at portions where the X and Y discharge electrodes 11*b* and 12*b* and the vertical barrier ribs 17*a* overlap with each other. In other words, in the shape of the electrodes according to the first embodiment, the X and Y discharge electrodes 11*b* and 12*b* are formed to be each separate for each display cell, and an X connection electrode 11*d* connecting the X discharge electrodes 11*b* that are adjacent across the vertical barrier rib 17*a* together and a Y connection electrode 12*d* connecting Y discharge electrodes 12*b* that are adjacent across the vertical barrier rib 17*a* together are provided. Here, in this example, for simplification of the drawing, the X and Y branch bus electrodes 11*c* and 12*c* are omitted, but are preferably provided. Even in the case where the X and Y discharge electrodes 11*b* and 12*b* are formed to be each separate for each display cell, as in this example, the discharge electrodes corresponding to the adjacent display cells are connected together. This is preferable because the influence of a wire break or the like can be reduce.

Also, unlike the first embodiment where the discharge electrodes corresponding to the adjacent display cells are formed as one electrode, with the notches 25 being provided as shown in FIG. 12A, it is possible to achieve an effect of reducing the influence of displacement in the horizontal direction when the substrates are bonded to form a panel. This effect is described below with reference to FIGS. 12B and 12C.

Figure 12B:
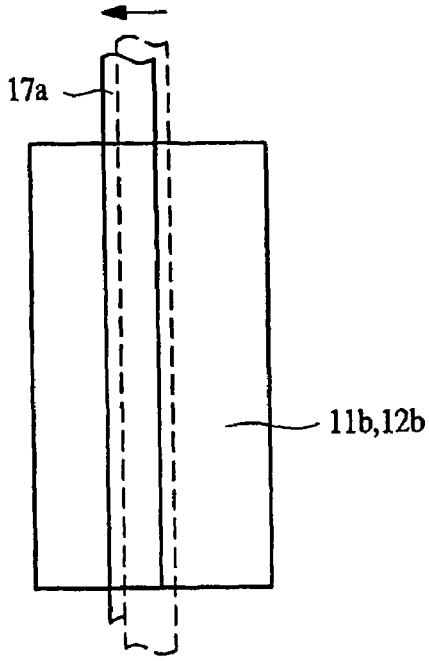
FIG. 12B is a view showing still other modification example of the electrode shape according to the first embodiment.

As described above, the discharge electrodes are formed on the first substrate 1, the barrier ribs 17*a* are formed on the second substrate 2, and these first and second substrates 1 and 2 are bonded together. At the time of bonding, a displacement may occur in the horizontal direction, that is, in the direction in which the X and Y bus electrodes 11*a* and 12*a* extend. FIG. 12B depicts a case where a displacement in the horizontal direction occurs when the discharge electrodes (11*b*, 12*b*) are rectangles. This displacement increases the discharge electrode area on one of the adjacent display cells and decreases the discharge electrode area on the other one thereof, thereby causing a change in an area ratio between the X discharge electrode 11*b* and the Y discharge electrode 12*b* in the display cells. In particular, each area ratio of the adjacent display cells are changed in reverse to a change in the discharge electrode area. The voltages applied to the X electrode and the Y electrode in each cell are not uniform due to a drop voltage by electrical resistance of the electrodes. Therefore, the area ratio between the X discharge electrode 11*b* and the Y discharge electrode 12*b* influences the intensity of a discharge, thereby changing the light emission intensity. For example, in an AC-type color PDP where phosphor layers of three colors, R, G, and B, are provided to three display cells adjacent in a first direction, if the discharge states of the adjacent display cells are varied, color balance is disadvantageously changed.

Figure 12C:
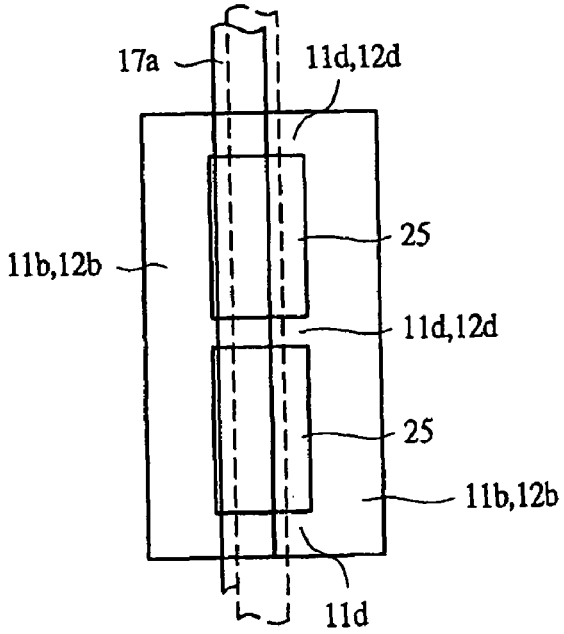
FIG. 12C is a view showing still other modification example of the electrode shape according to the first embodiment.

FIG. 12C depicts a case where the notches 25 are provided. With these notches 25, even if the vertical barrier rib 17*a* and the discharge electrodes (11*b*, 12*b*) are displaced due to a bonding displacement, a change in area ratio between the X discharge electrode 11*b* and the Y discharge electrode 12*b* in the display cells is reduced compared with the case without the notches 25. Specifically, the influence of the displacement is reduced to a ratio between a total width of the connect electrodes 11*d* and 12*d* connecting right and left electrode portions together and the width of the discharge electrode (11*b*, 12*b*).

The modification examples of the shape of the electrodes according to the first embodiment have been described above. Various other modification examples are possible and, needless to say, the features of the modification examples shown in the drawings can be combined.

Figure 13:
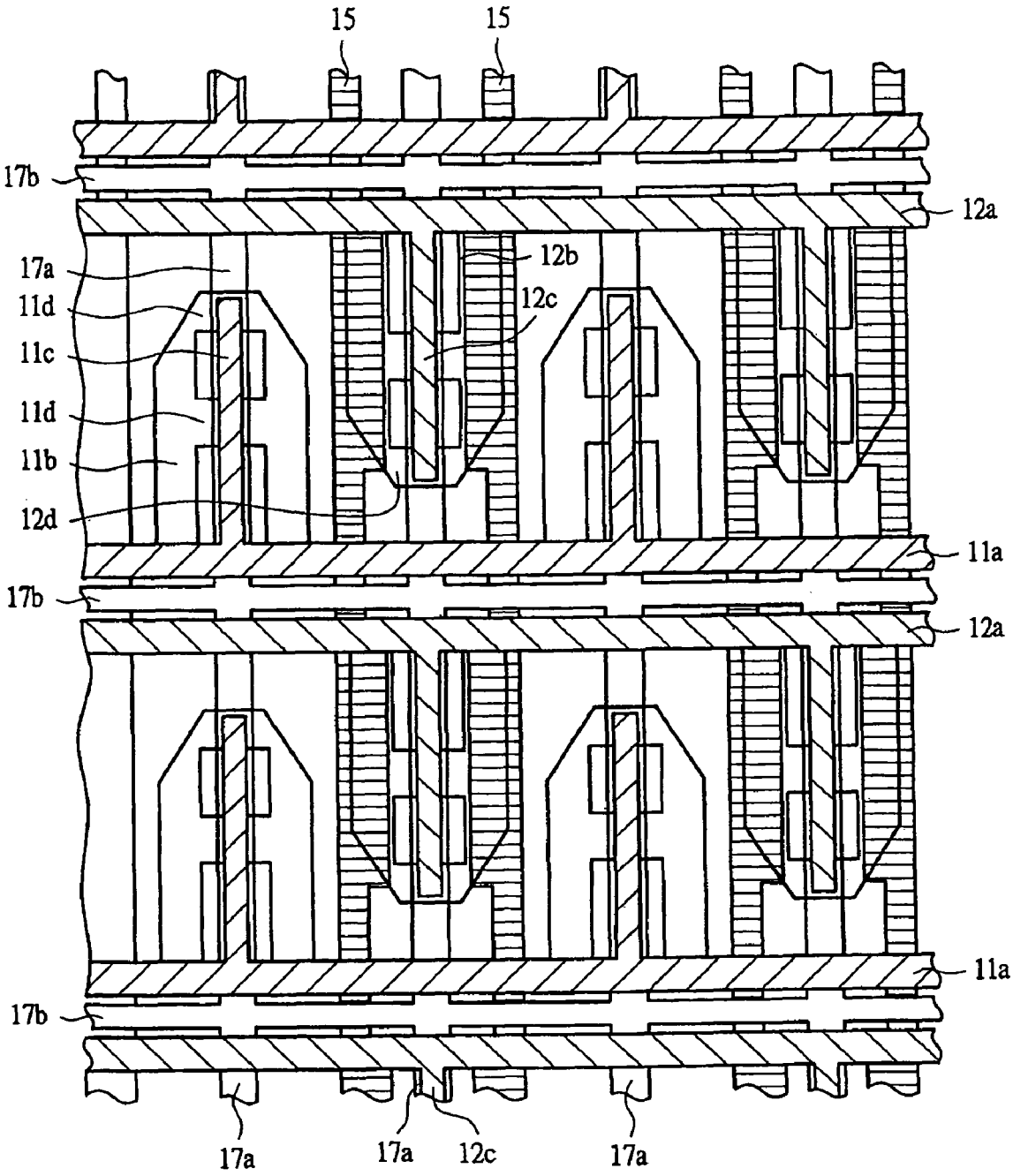
FIG. 13 is a view showing an electrode shape and arrangement of a PDP according to a second embodiment of the present invention.

FIG. 13 is a drawing of a shape of electrodes of a PDP according to a second embodiment of the present invention. The PDP according to the second embodiment has a structure identical to that according to the first embodiment, except the shape of the electrodes. In the shape of the electrodes according to the second embodiment, the notches 25 shown in FIG. 12A are provided to the shape of the electrodes according to the first embodiment. That is, the X and Y discharge electrodes 11*b* and 12*b* are each separated for each of the adjacent cells, and the X and Y connect electrodes 11*d* and 12*d* are provided to connect the separate electrodes together.

Also, as shown in FIG. 13, in the second embodiment, the shape of the electrodes in the horizontal direction for one line is repeated in the vertical direction. Therefore, the X and Y discharge electrodes 11*b* and 12*b* are disposed along one line in the vertical direction. Accordingly, the address electrodes 15 are disposed at narrow gaps in portions of the Y discharge electrodes 12*b* and at wide gap in portions of the X discharge electrodes 11*b*.

In the PDP according to the second embodiment, the shape of the electrodes for one line is repeated, and various modification examples of the repeated shape are possible. Such modification examples of the repeated shapes are described below.

Figure 14:
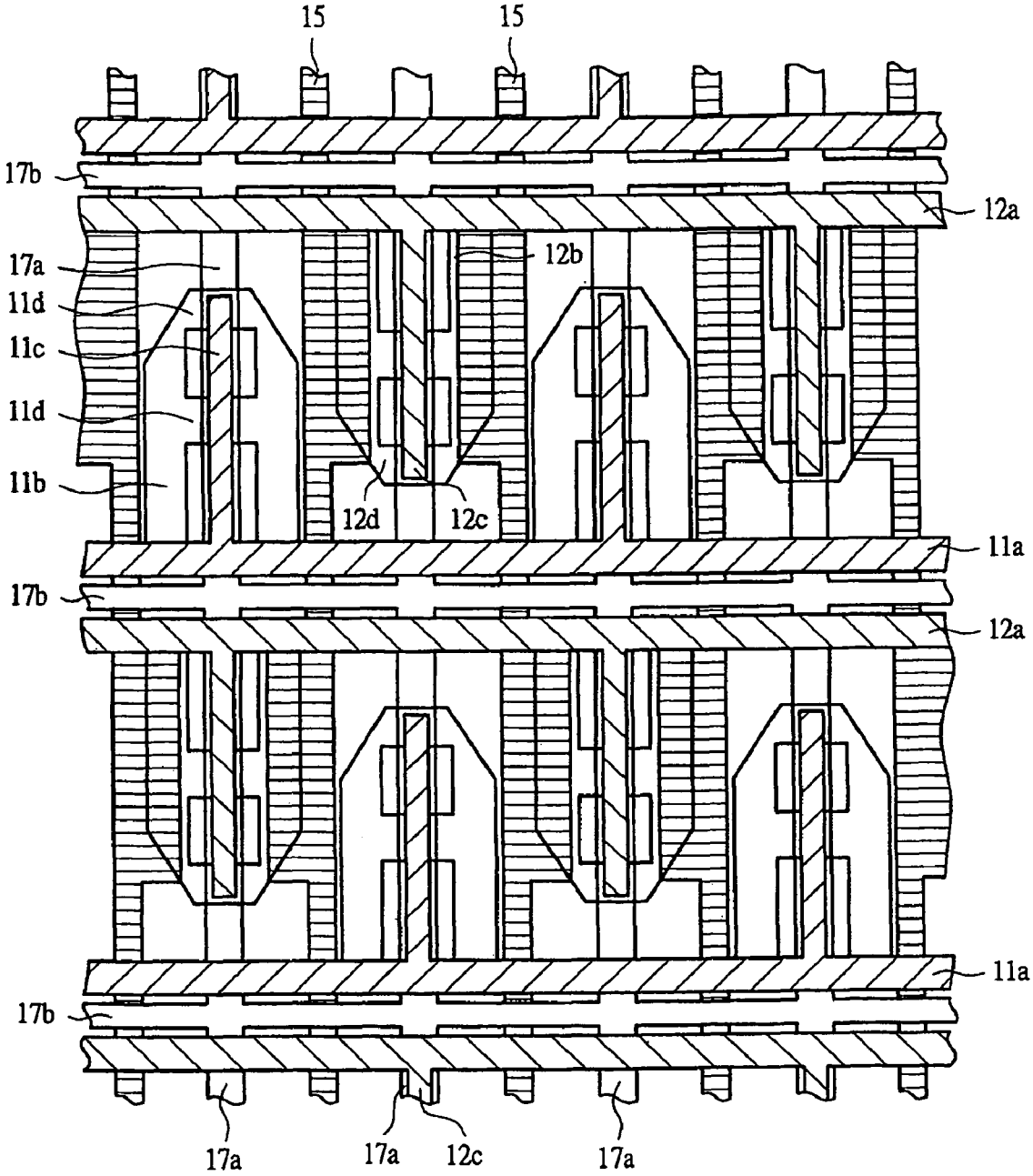
FIG. 14 is a view showing a modification example of the electrode arrangement according to the second embodiment.

FIG. 14 is a drawing of a modification example of the repeated shape. In this modification example, as shown, the positions of the X discharge electrode 11*b* and the Y discharge electrode 12*b* that are adjacent to each other on a vertical line are displaced in the horizontal direction by one display cell. The address electrodes 15 are disposed at the same gaps, and each has a width increased in the horizontal direction in a portion of the Y discharge electrode 12*b* so as to overlap with the Y discharge electrode 12*b* in a large area. Therefore, the address electrodes 15 have widths alternately increased rightward and leftward for every display line.

Figure 15:
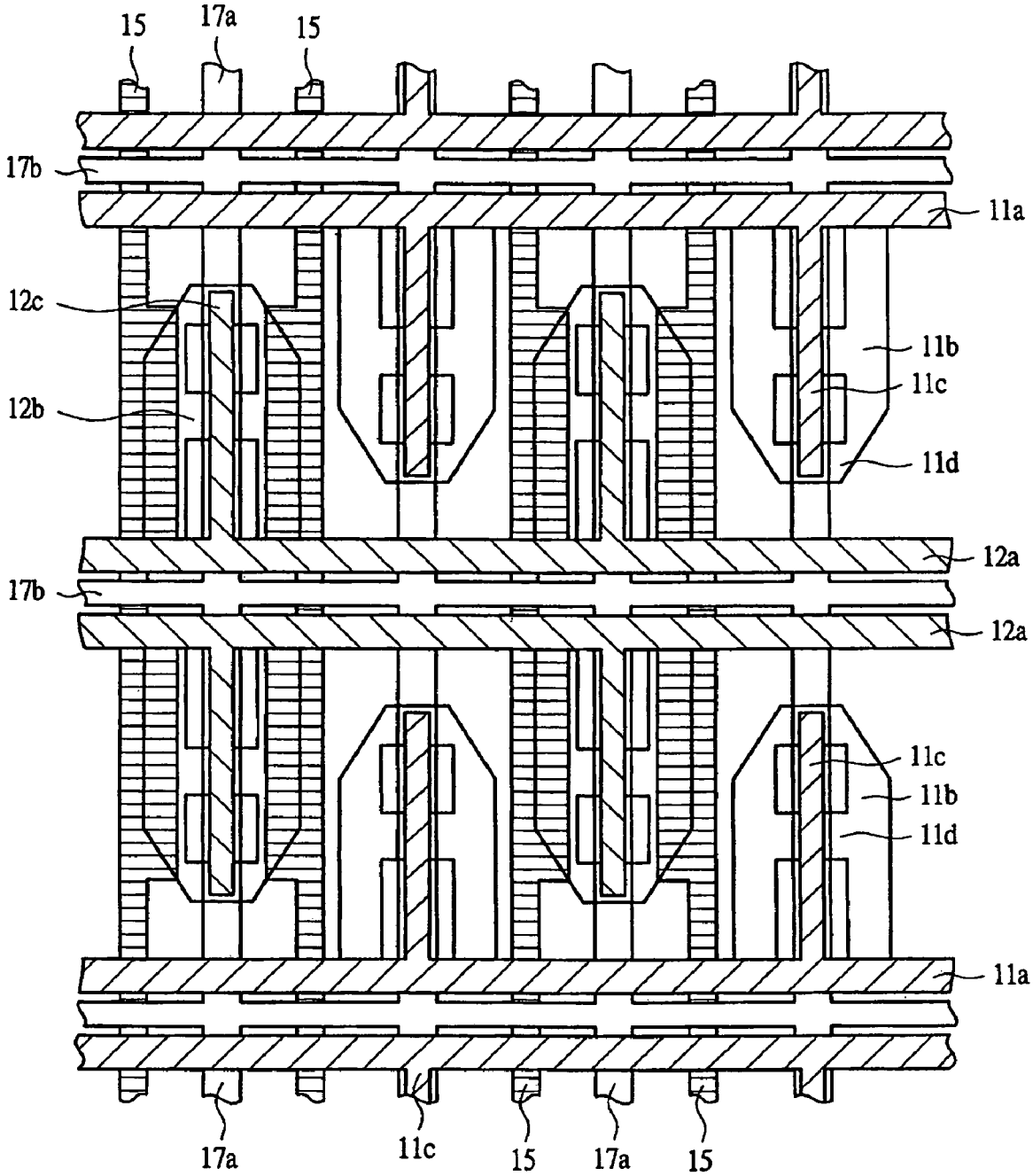
FIG. 15 is a view showing another modification example of the electrode arrangement according to the second embodiment.

FIG. 15 is a drawing of another modification example of the repeated shape. In this modification example, as shown, a set of two X bus electrodes 11*a* and a set of two Y bus electrodes 12*a* are alternately disposed. The X and Y discharge electrodes 11*b* and 12*b* are disposed along one line in the vertical direction. Also in this case, the address electrodes 15 are disposed at narrow gaps in a portion of the Y discharge electrode 12*b* and at wide gaps in a portion of the X discharge electrode 11*b* and have a wide width at a portion of the Y discharge electrode 12*b*.

Figure 16:
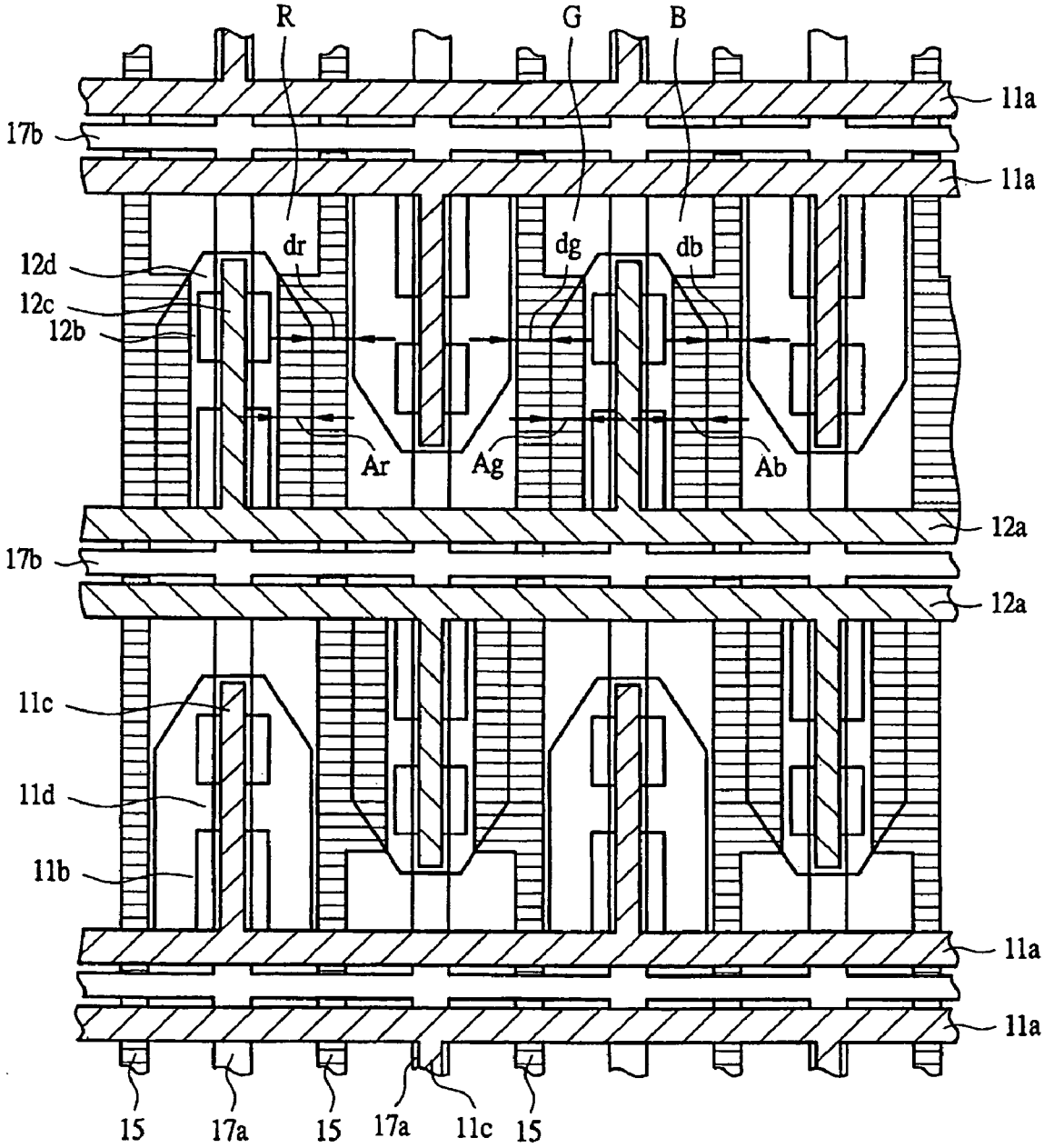
FIG. 16 is a view showing still another modification example of the electrode arrangement according to the second embodiment.

FIG. 16 is a drawing of still another modification example of the repeated shape. In this modification example, as shown, a set of two X bus electrodes 11*a* and a set of two Y bus electrodes 12*a* are alternately disposed. The positions of the X discharge electrode 11*b* and the Y discharge electrode 12*b* that are adjacent to each other on a vertical line are displaced in the horizontal direction by one display cell. The address electrodes 15 are disposed at the same gaps, and each has a width increased in the horizontal direction in a portion of the Y discharge electrode 12 so as to overlap with the Y discharge electrode 12*b* in a large area. Therefore, the address electrodes 15 have widths alternately increased rightward and leftward for every display line.

Also, still another modification example is described with reference to FIG. 16. In the drawing, R, G, and B represent red (R), green (G), and blue (B), respectively, of emitted colors of the cells. Each cell has a different phosphor applied thereto. Depending on the characteristic of the phosphor and the applied film thickness, the discharge characteristics of the cells are different from one another. Therefore, by changing gaps "dr", "dg", and "db" of the X and Y discharge electrodes in accordance with the discharge characteristics of the cells, the discharge voltages on the entire panel can be made uniform. For example, when the discharge voltage for G is the highest, then comes that for B, and then that for R, the discharge gaps are made narrow so that dr>db>dg, thereby equalizing the discharge voltages. Here, it is not required to change all of the slit spaces for three colors, and only one of them may be varied.

Furthermore, in an address discharge, areas of the Y discharge electrode and the address electrode that are different from one another (in this drawing, overlapping widths Ar, Ag, and Ab) are changed, thereby equalizing the discharge voltages. For example, if the discharge voltage for G is the highest, then comes that for B, and then that for R, the overlapping widths are set so that Ag>Ab>Ar, thereby equalizing the discharge voltages. Also in this case, it is not required to change all of the slit spaces for three colors, and only one of them may be varied.

Figure 17:
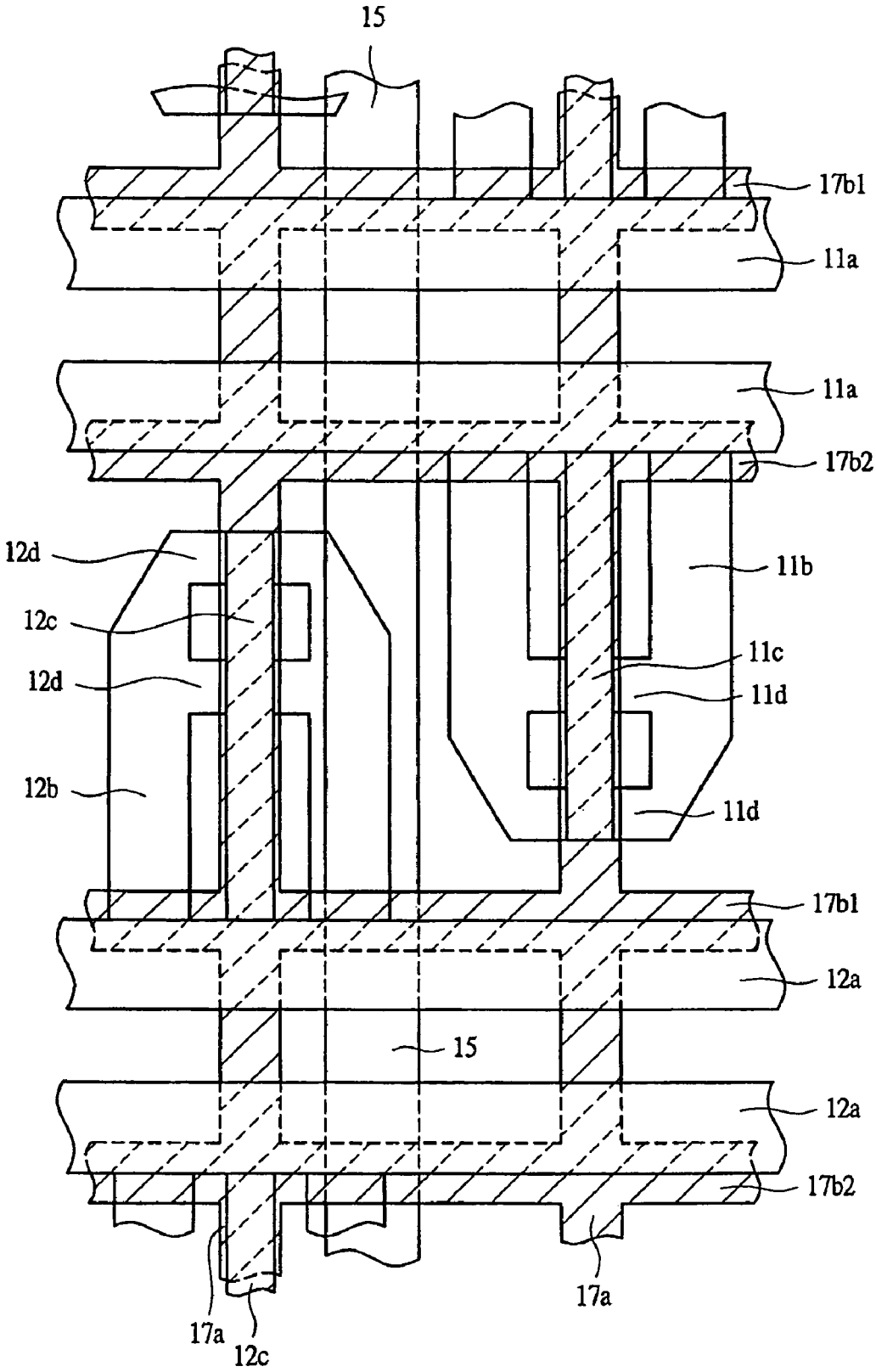
FIG. 17 is a view showing an electrode shape and arrangement of a PDP according to a third embodiment of the present invention.

FIG. 17 is a drawing that depicts a shape of electrodes of a PDP apparatus according to a third embodiment of the present invention. The PDP apparatus according to the third embodiment has a structure similar to that of the PDP apparatus according to the first embodiment, except the shape of the electrodes and the shape of the barrier ribs. The shape of the electrodes according to the third embodiment is similar to that of the modification example shown in FIG. 15. However, in the third embodiment, the horizontal barrier rib 17*b* according to the first and second embodiments is divided into two horizontal barrier ribs 17*b*1 and 17*b*2, which are disposed so as to cover one of edges of the X and Y bus electrodes 11*a* and 12*a*, respectively, that is on a side from which the discharge electrode protrudes. With this, discharges between the tips of the X and Y discharge electrode 11*b* and 12*b* and the X and Y bus electrode 11*a* and 12*a* are suppressed, thereby reducing the distance therebetween. Also, in the drawing, the connect electrode 11*d* (12*d*) is provided in a portion where the slit gap "d" of the discharge electrode 11*b* (12*b*) is the narrowest, that is, a portion near a discharge start point. With this, a drop in voltage particularly at the time of a discharge start is prevented. This structure can be combined with the first and second embodiments including the connect electrodes.

Figure 18:
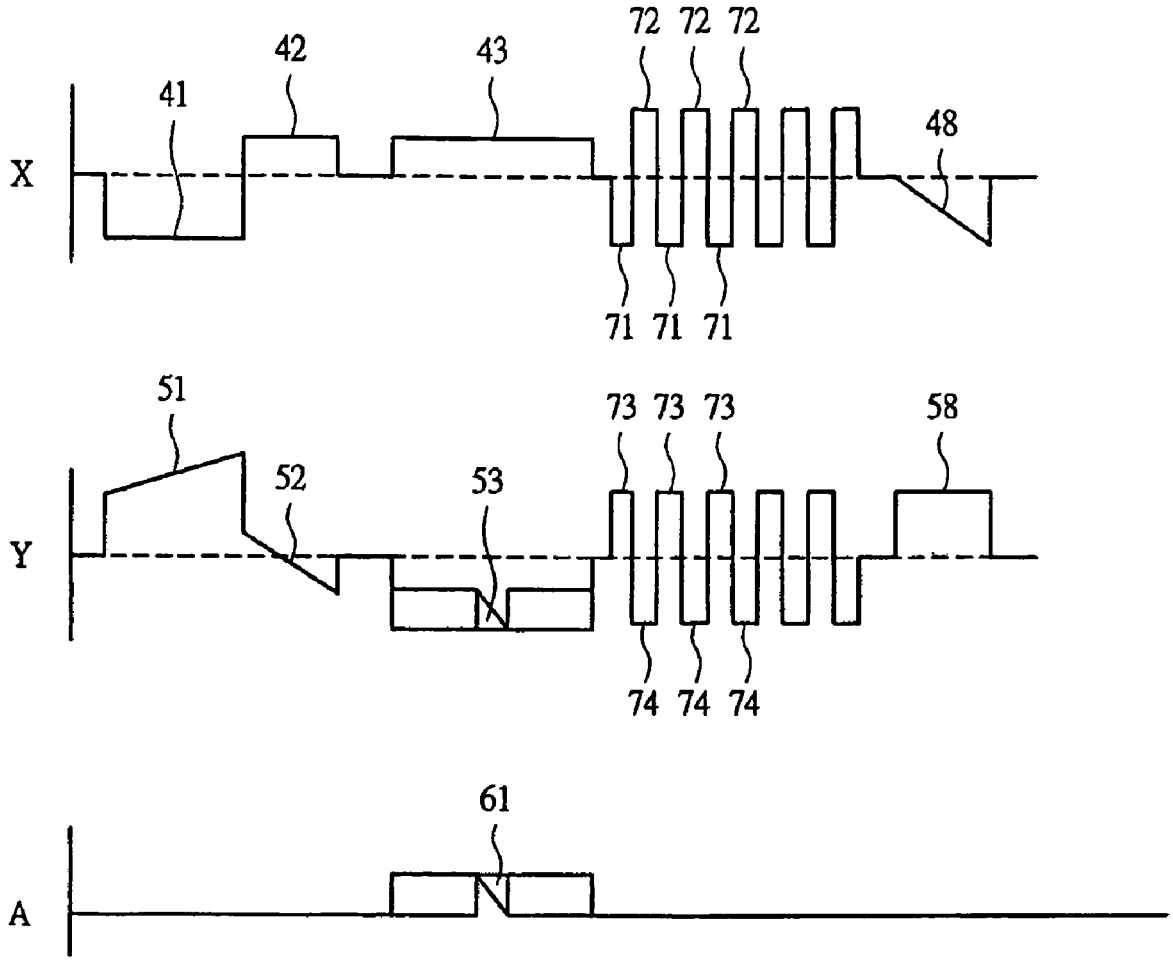
FIG. 18 is a view showing a drive waveform of a PDP apparatus according to a fourth embodiment.

FIG. 18 is a drawing that depicts drive waveforms of a PDP apparatus according to a fourth embodiment of the present invention. The PDP apparatus according to the fourth embodiment has a structure similar to that according to the first embodiment, except the drive waveforms. In the PDP according to the present invention, a portion of the discharge electrode away from the slit is small. Therefore, compared with the conventional technology, a discharge convergence is achieved within a short period, thereby forming wall charges within a short period. For this reason, space charges are rapidly decreased, and therefore a cycle of repeating a sustain discharge has to be shortened. However, as the size of the panel is increased, ringing or the like tends to occur more often, which makes it difficult to apply a short pulse at a constant voltage.

As shown in FIG. 18, drive waveforms in the reset period and the address period according to the fourth embodiment are identical to those according to the first embodiment. However, the drive waveforms according to the conventional technology with the omission of the first sustain pulses, pulses for matching the polarity of the charges, on-cell delete pulses, and others are used. As with the first embodiment, these omitted pulses can be provided. In a sustain period according to the fourth embodiment, sustain pulses allowing a period in which a discharge voltage is applied between two electrodes to be varied in a cycle shorter than the cycle of the sustain pulses according to the first embodiment is used.

Figure 19:
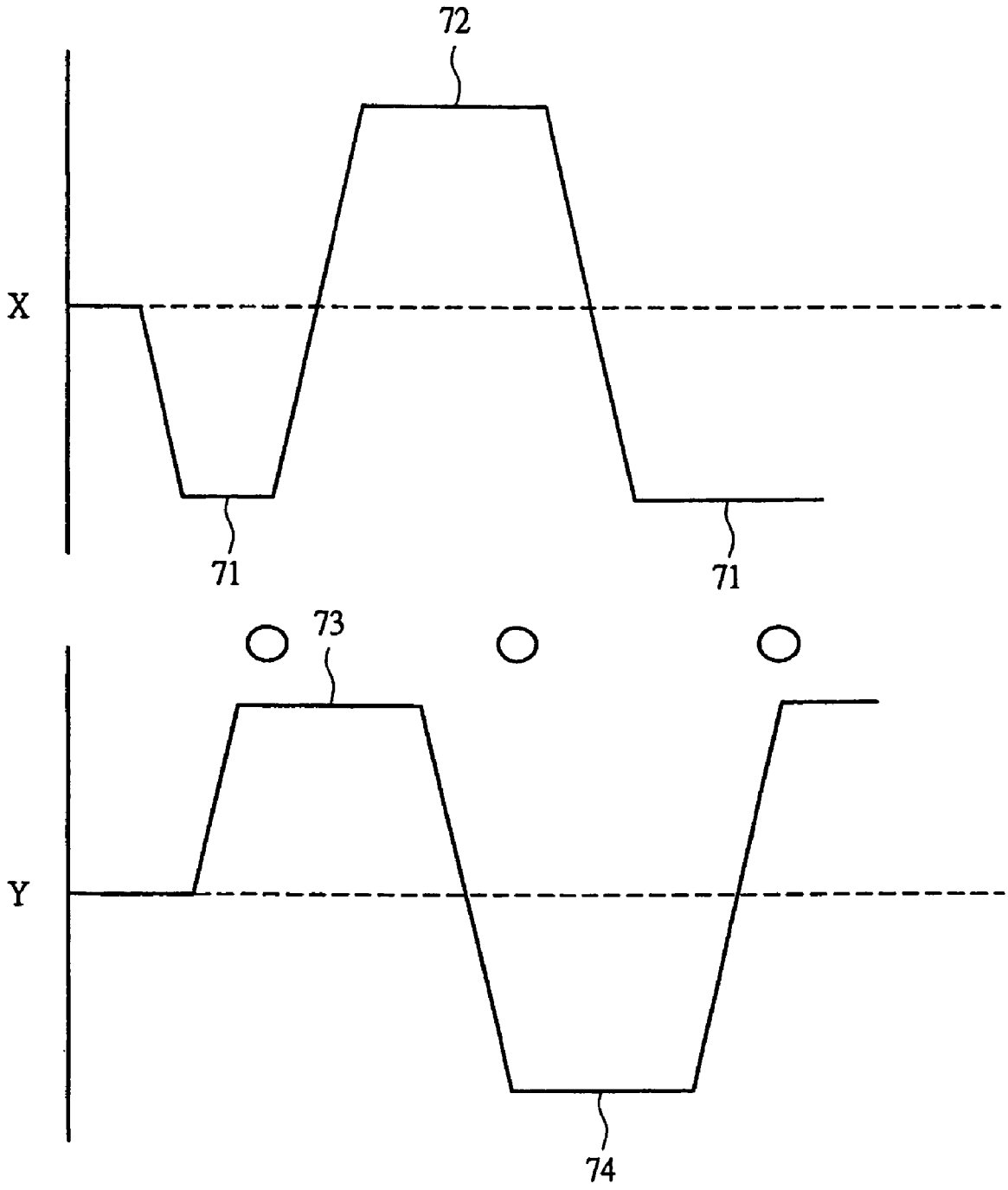
FIG. 19 is a view showing details of the drive waveform according to the fourth embodiment.

FIG. 19 is a drawing that depicts details of the sustain pulses according to the fourth embodiment. As shown, a sustain pulse applied to the X electrodes (X bus electrode, X branch bus electrode, and X discharge electrode) and a sustain pulse applied to the Y electrodes (Y bus electrode, Y branch bus electrode, and Y discharge electrode) are varied so as to have opposite polarities and shifted in phase by 90 degrees. Therefore, a period in which a discharge voltage is applied between two electrodes is a period of half of one pulse. Therefore, a reduction in space charge can be suppressed even with the same pulse width. As such, even without shortening the cycle of the sustain pulse, a sustain discharge can be kept so as to successively occur. Thus, a stable display can be achieved.

Figure 20:
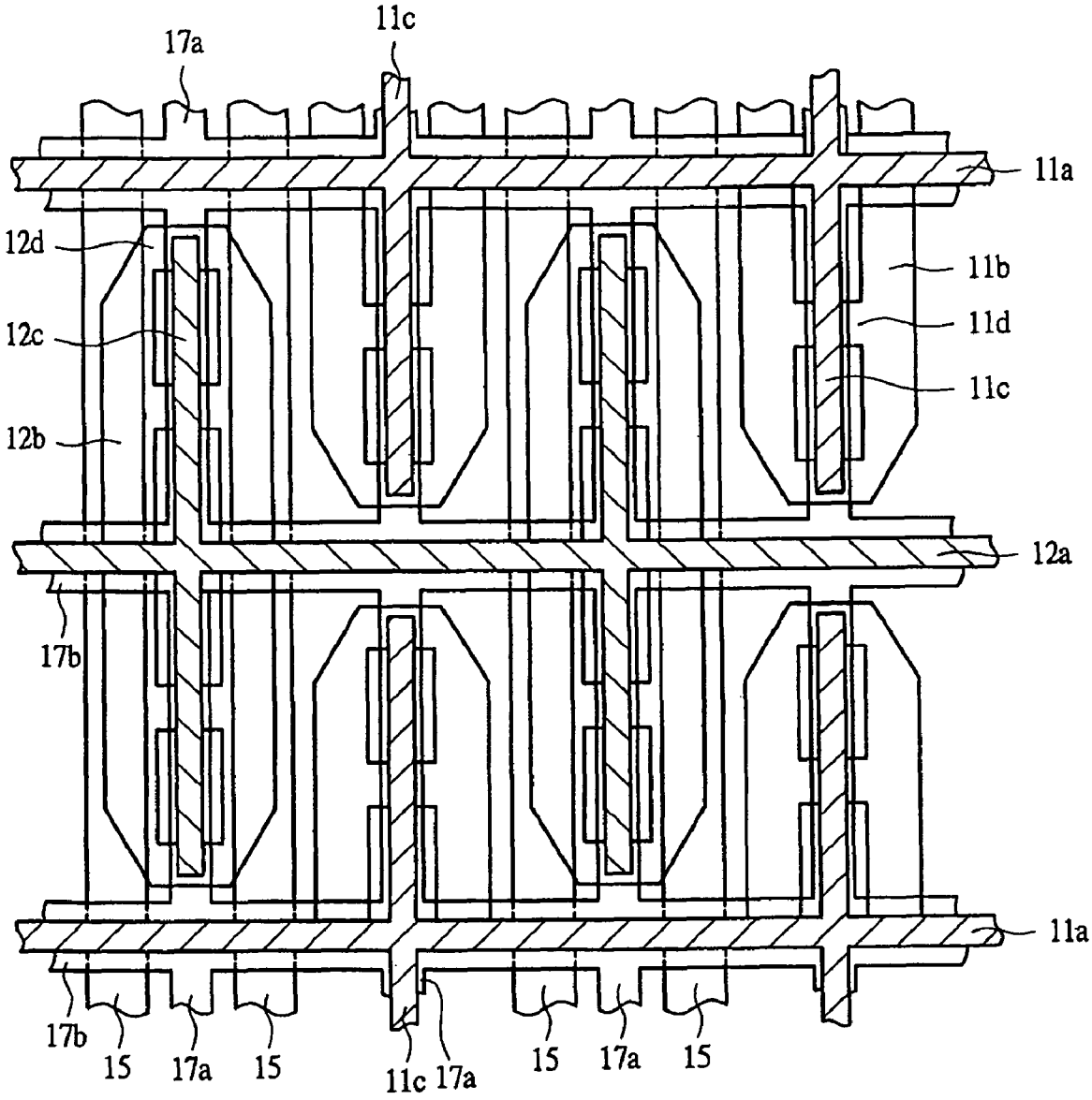
FIG. 20 is a view showing an electrode shape and arrangement of a PDP according to a fifth embodiment of the present invention.

FIG. 20 is a drawing that depicts a shape of electrodes of a PDP apparatus according to a fifth embodiment of the present invention. The present invention can be applied to so-called ALIS PDP apparatuses described in the above-mentioned Patent Document 5. The fifth embodiment is an example in which the present invention is applied to an ALIS PDP apparatus. The PDP apparatus according to the fifth embodiment has a structure identical to a conventional ALIS PDP apparatus, except a horizontal rib provided under the bus electrode and the shape of the electrodes.

In an ALIS PDP, a plurality of X bus electrodes and a plurality of Y bus electrodes are alternately disposed, and the number of X bus electrodes is larger by one than the number of Y bus electrodes. From each of the top and bottom X bus electrodes, an X discharge electrode protrudes toward an internal Y bus electrode. From each of the other X bus electrodes and the Y bus electrodes, X and Y discharge electrodes protrude to both sides.

In the shape of the electrodes according to the fifth embodiment, the Y branch bus electrodes 12*c* protrude from the Y bus electrode 12*a* to both sides toward the vertical barrier rib 17*a* so as to overlap with every other vertical barrier rib 17*a*, and further the Y discharge electrodes 12*b* protrude from the Y bus electrode 12*a* to both sides so as to each include the Y branch bus electrode 12*c*. Similarly, from each of the X bus electrodes 11*a* vertical adjacent to each other, the X branch bus electrodes 11*c* and the X discharge electrodes 11*b* protrude to both sides, and a set of the X branch bus electrode 11*c* and the X discharge electrode 11*b* and a set of the Y branch bus electrode 12*c* and the Y discharge electrode 12*b* are alternately disposed in the horizontal direction.

The X and Y discharge electrodes 11*b* and 12*b* have shapes similar to those of the discharge electrodes according to the second embodiment. Also, the horizontal barrier rib 17*b* is provided so as to cover the X bus electrode 11*a* and the Y bus electrode 12*a*. Therefore, gaps between the tips of the X and Y discharge electrodes 11*b* and 12*b* and the X and Y bus electrodes 11*a* and 12*a* can be narrowed more than those according to the first embodiment.

In the ALIS technology, an odd-numbered display line is formed between an odd-numbered X bus electrode and an odd-numbered Y bus electrode and between an even-numbered X bus electrode and an even-numbered Y bus electrode, whilst an even-numbered display line is formed between an odd-numbered Y bus electrode and an even-numbered X bus electrode and between an even-numbered Y bus electrode and an odd-numbered X bus electrode. Odd-numbered display lines and even-numbered display lines are alternately subjected to an interlace display in odd fields and even fields.

Figure 21:
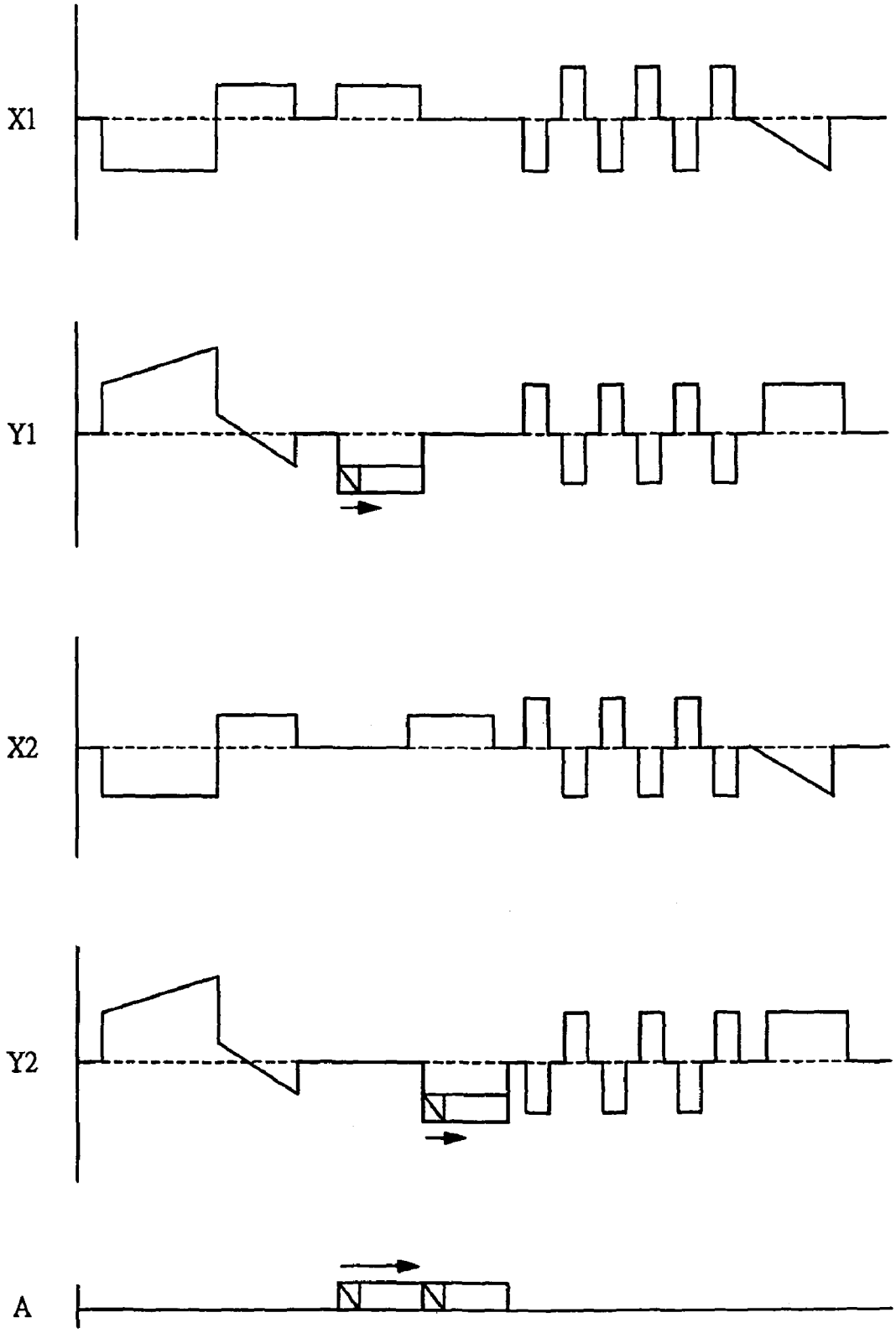
FIG. 21 is a view showing a drive waveform (in odd fields) according to the fifth embodiment.
Figure 22:
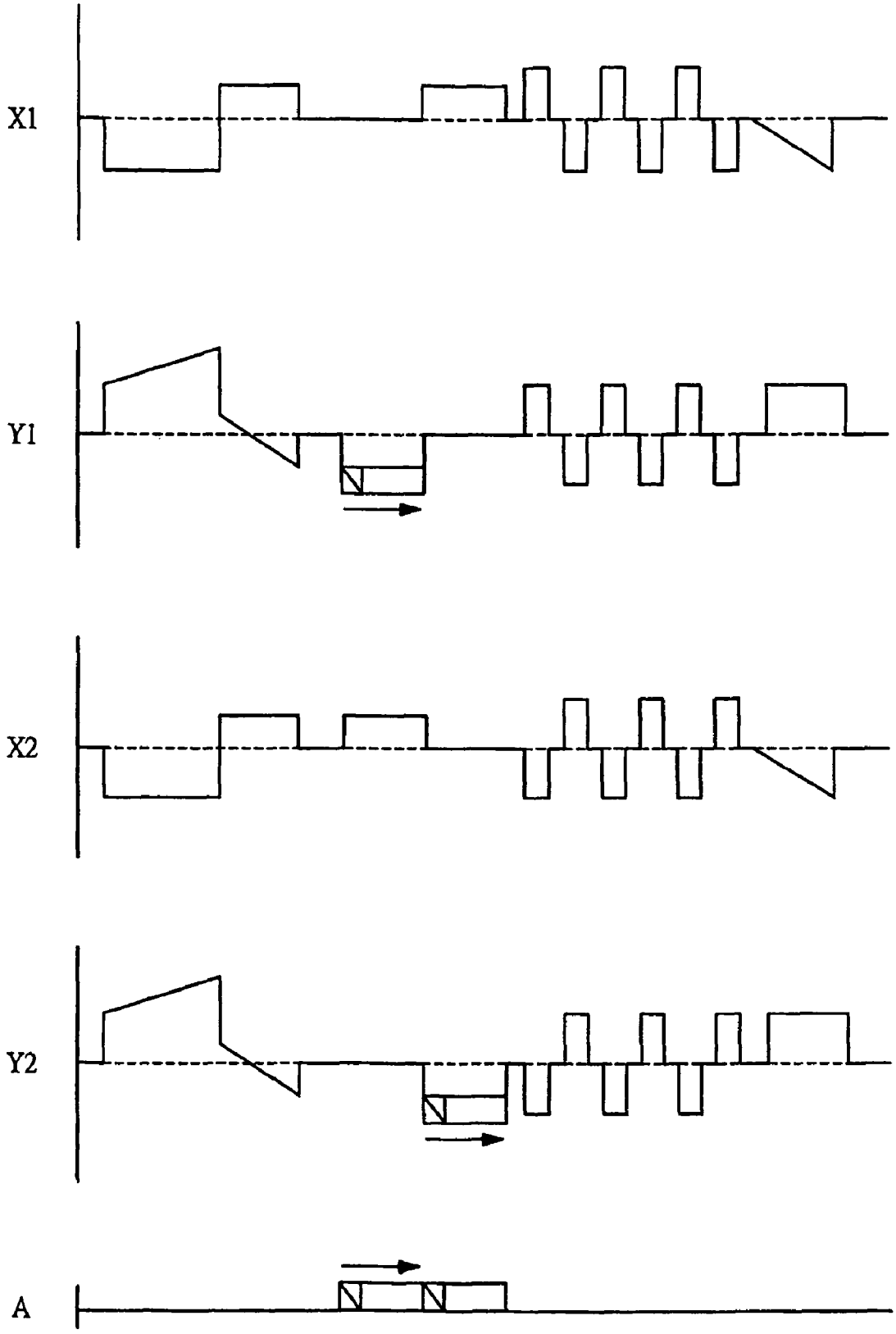
FIG. 22 is a view showing a drive waveform (in even fields) according to the fifth embodiment.

Also, FIGS. 21 and 22 are drawings that depict drive waveforms of the PDP apparatus according to the fifth embodiment, wherein FIG. 21 depicts drive waveforms in odd fields, whilst FIG. 22 depicts drive waveforms in even fields. Here, drive waveforms of a conventional technology without using first sustain pulses, pulses for matching the polarities of the charges, the on-cell delete pulses, and others are used. Alternatively, as with the first embodiment, these omitted pulses can be provided.

The ALIS technology is described in the above-mentioned Patent Document 5, and the driving method is not described in detail herein.

The X and Y discharge electrodes 11*b* and 12*b* according to the fifth embodiments have shapes similar to those according to the second embodiment. Therefore, effects similar to those according to the second embodiment can be achieved in an ALIS PDP apparatus.

Figure 23:
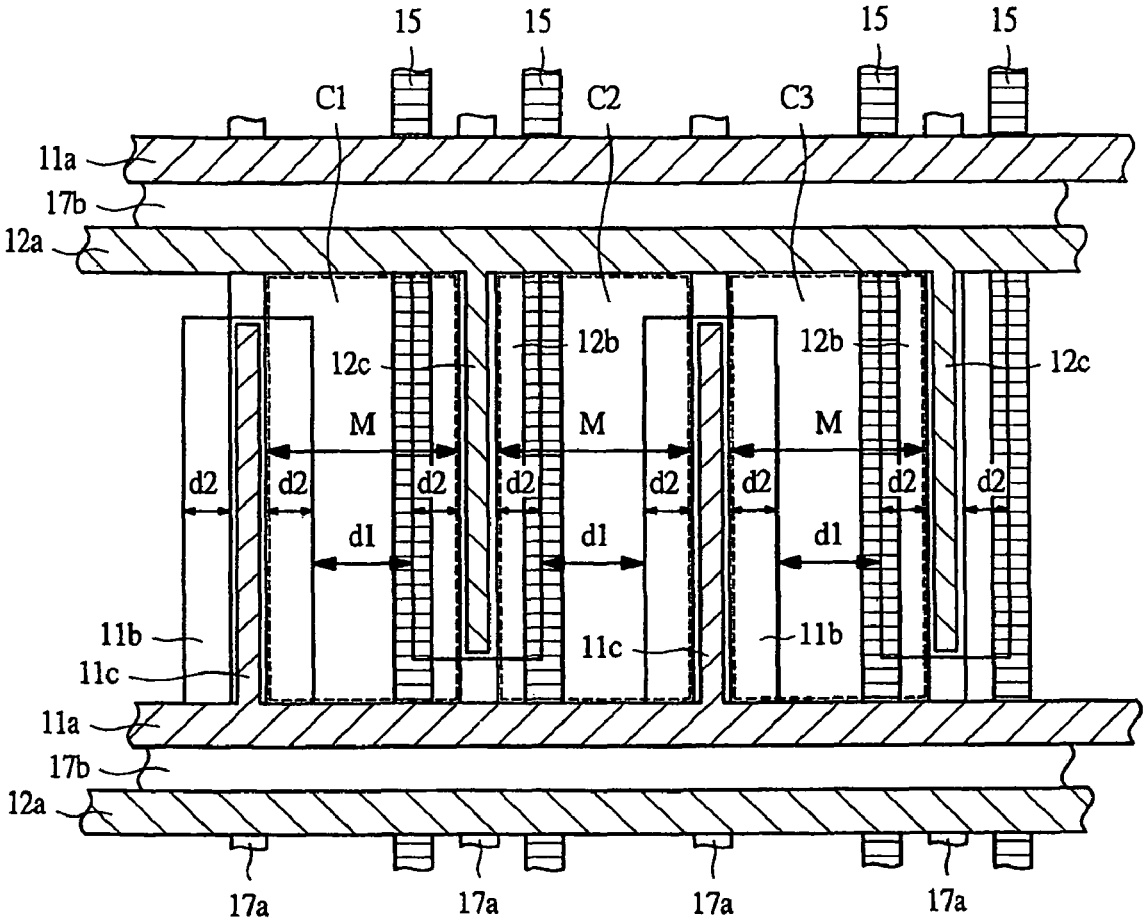
FIG. 23 is a view showing an electrode shape of a PDP in a PDP apparatus according to a sixth embodiment of the present invention.

Next, the structure of a PDP apparatus according to a sixth embodiment of the present invention is described. FIG. 23 is a drawing of a shape of electrodes of a PDP in a PDP apparatus according to the sixth embodiment of the present invention. The PDP apparatus according to the sixth embodiment has a structure similar to that according to the first embodiment, for example, except the shape of the electrodes of the PDP. In the shape of the electrodes according to the sixth embodiment, based on the shape of the electrodes according to the modification example of the first embodiment shown in FIG. 11, the design of the widths of the discharge electrodes and the discharge slits according to the sixth embodiment are different from those according to the first embodiment. Drive waveforms for the PDP are similar to, for example, those in FIG. 8.

In FIG. 23, on a display panel, in areas each defined by barrier ribs (17*a*, 17*b*) in each display cell and corresponding to a discharge space (for example, such areas are represented by areas C1, C2, and C3 adjacent to one another and corresponding to pixels), the rectangular X and Y discharge electrodes 11*b* and 12*b* and vertically-elongated rectangular discharge slits from the edges are provided. The discharge electrodes (11*b*, 12*a*) are shared and integrated between the adjacent display cell. Also, each bus electrodes (11*a*, 12*a*) are provided so as to are superposed on the horizontal barrier rib 17*b*. Also, each branch bus electrodes (11*c*, 12*c*) are provided so as to be superposed on the vertical barrier rib 17*a*. Also, the address electrodes 15 are disposed so as not to overlap with the X discharge electrode 11*b* but to overlap with at least partially overlap with an in-cell breadth portion of the Y discharge electrode 12*b*. Here, the horizontal barrier rib 17*b* can have various structures described above.

As a design of distances in the horizontal direction (first direction), consider a breadth (d2) of each discharge electrode (11*b*, 12*b*) and a breadth (d1) of each discharge slit in the in-cell areas (C1 to C3). The in-cell breadths of the X and Y discharge electrodes 11*b* and 12*b* are identical to each other as d2 (this is the case no displacement in the horizontal direction). d1 represents an edge gap between the facing discharge electrodes (11*b*, 12*b*). d2 represents a distance from an edge of the discharge electrode (11*b*, 12*b*) on a slit side to an upper end of the vertical barrier rib 17*a* inside the cell. d1 and d2 are constant irrespectively of the positions in the vertical direction (second direction).

In the structure shown in FIG. 11, the distance relation between distances equivalent to d1 and d2 is assumed to be d1<d2. That is, regarding the discharge slit gaps, the breadth in a cell of the discharge electrode is made larger. On the other hand, in the PDP according to the sixth embodiment, as shown in FIG. 23, in each in-cell area (C1 to C3), the structure is such that d1>d2, that is, d2/d1<1. Also, with the breadth in each of in-cell areas (C1 to C3) being taken as M, d1>M/3 and d2<M/3 hold.

The breadths of the two discharge electrodes (11*b*, 12*b*) in a cell may be different from each other, but are desirably the same (d2).

Figure 24:
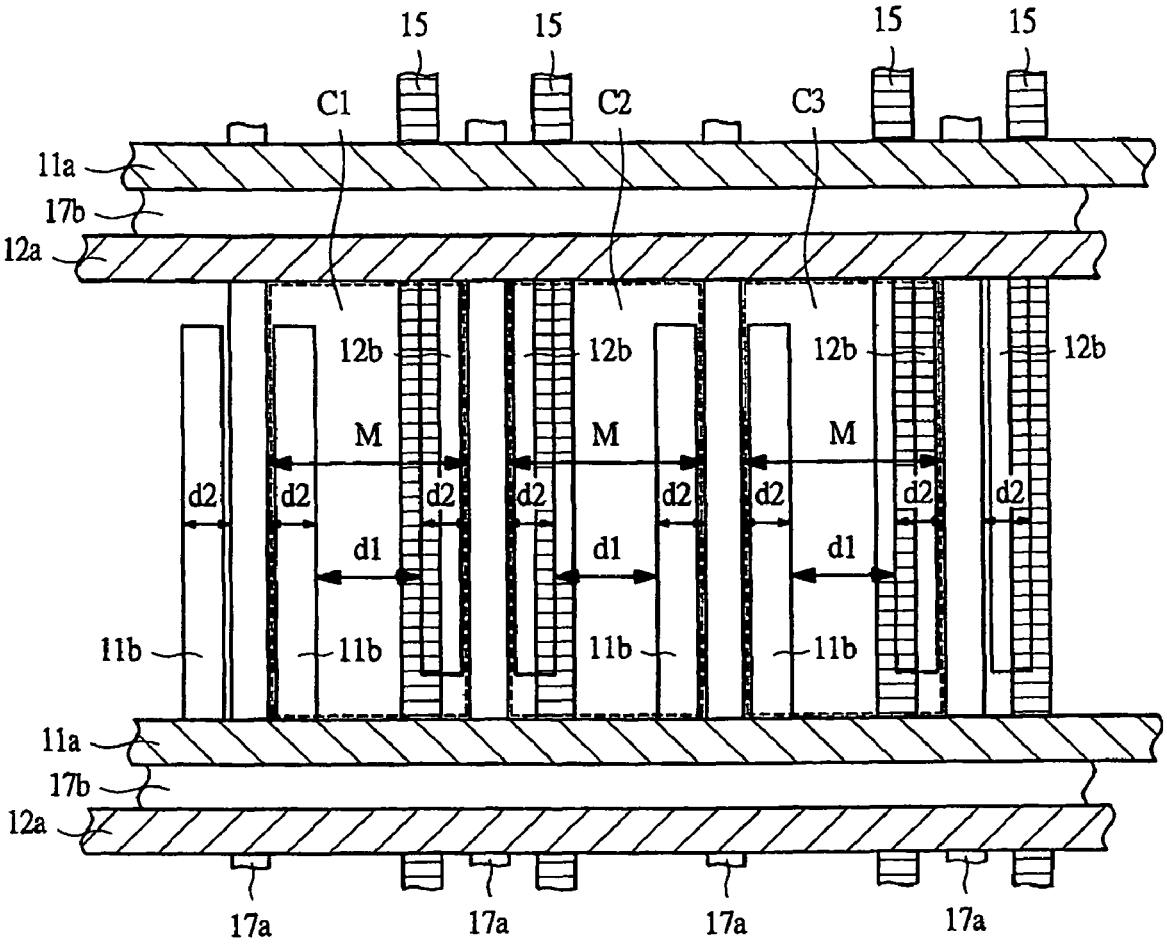
FIG. 24 is a view showing a modification example of the electrode shape according to the sixth embodiment.
Figure 25:
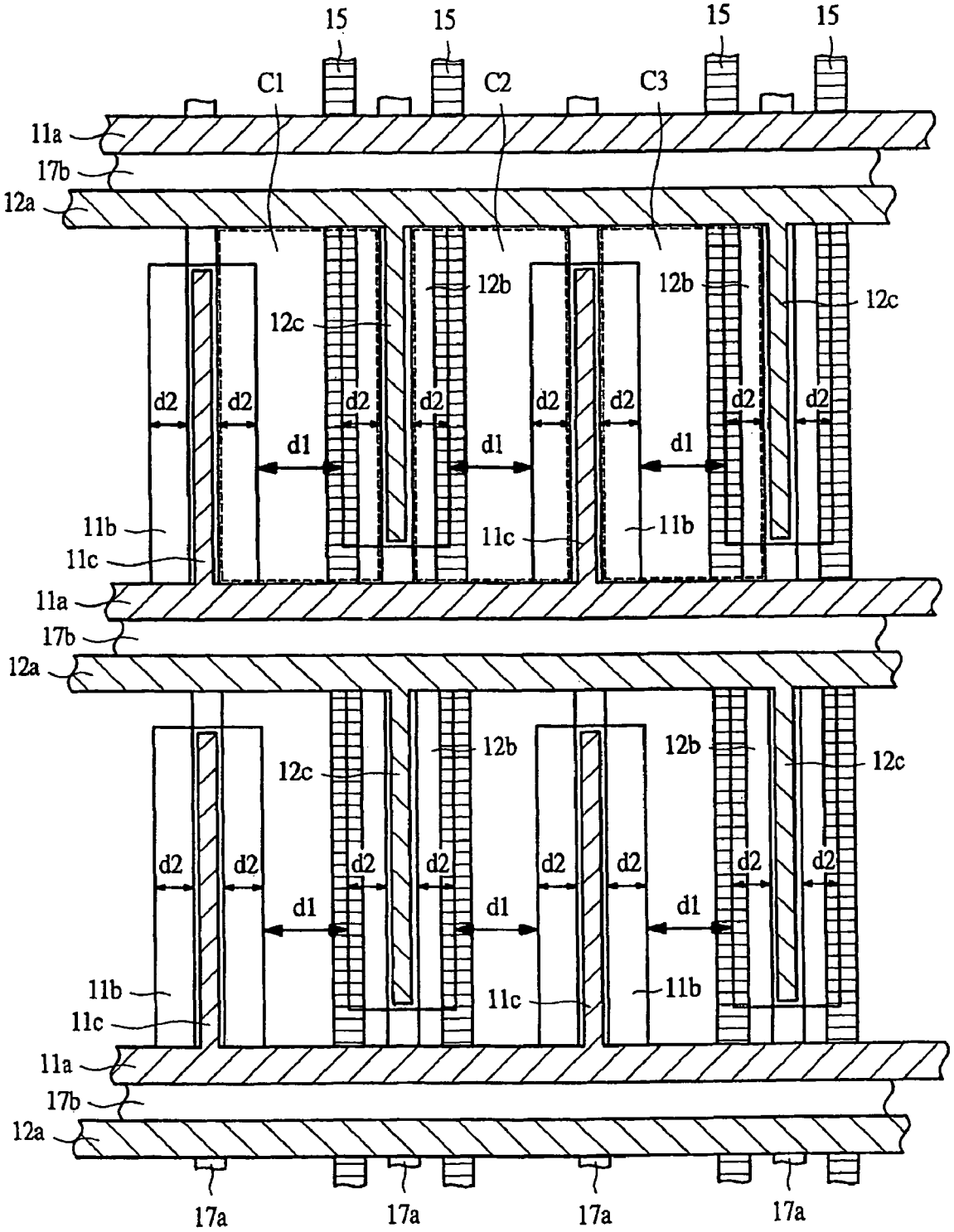
FIG. 25 is a view showing another modification example of the electrode shape according to the sixth embodiment.

FIGS. 24 and 25 depict modification examples of a shape of electrode of a PDP according to a sixth embodiment. In the shape of the electrodes shown in FIG. 24, unlike the structure shown in FIG. 23 where the X and Y discharge electrodes 11*b* and 12*b* are shared and integrated between the adjacent display cells, the X and Y discharge electrodes 11*b* and 12*b* are each separated for each display cell, as shown in FIG. 9B. Also, the X and Y branch bus electrodes 11*c* and 12*c* are removed, but may be provided. The relation between d1 and d2 is similar to that shown in FIG. 23. The breadth (d2) of each discharge electrode (11*b*, 12*b*) represents a distance from an edge thereof on a slit side to another edge corresponding to an upper end of the vertical barrier rib 17*a* inside the cell. From this shape of the electrodes, the same effects as those in FIG. 23 can be achieved.

In the shape of the electrodes shown in FIG. 25, the structure of the shape of the electrodes in the horizontal direction for one line shown in FIG. 23 is repeatedly provided in the vertical direction, typically as with FIG. 13. As with the second embodiment, the repeated shape can be variously modified. In the example of FIG. 25, the positions in the horizontal direction and the protruding orientations of the X discharge electrode 11*b* and the Y discharge electrode 12*b* are identical among the structures vertically adjacent on the same line. The address electrodes 15 are disposed so as to be near the Y discharge electrode 12*b* side to narrow the gap therebetween The PDP apparatus according to the sixth embodiment is not restricted to that of the modification example, but may be a combination of the features according to the first through fifth embodiments. Here, if there is a difference between d1 and d2 in accordance with the second direction, a relation is set so that an average value of d1 and d2 is made so as to satisfy d1>d2 described above.

Figure 26:
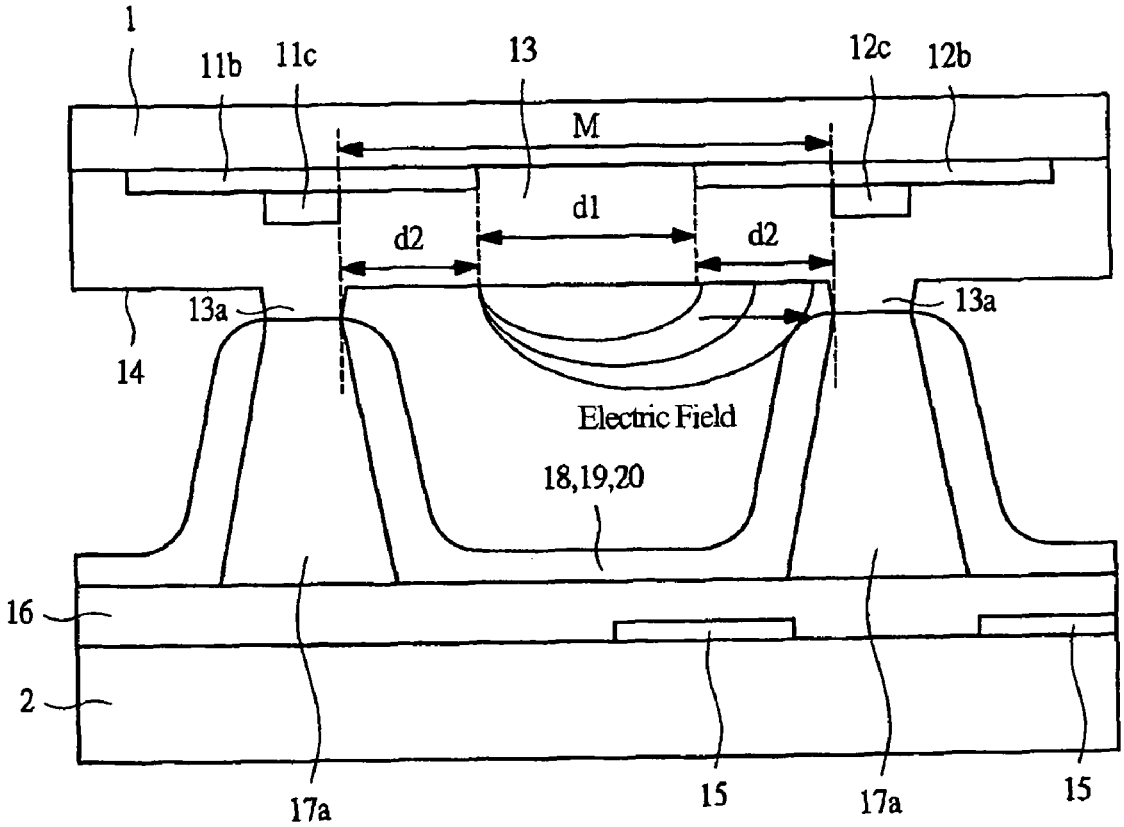
FIG. 26 is a view showing a cross section and an electric field of the PDP according to the sixth embodiment.

FIG. 26 is a sectional view of a PDP according to a sixth embodiment, depicting a section corresponding to a discharge slit in the horizontal direction. The first substrate 1 has formed thereon, particularly above each of the vertical barrier rib 17*a*, the X and Y discharge electrodes 11*b* and 12*b* (ITO films), the X and Y branch bus electrodes 11*c* and 12*c* (metal films), the dielectric layer 13 ($SiO_2$), and then the protective layer 14 (Mgo) in this order. Also, in an area making contact with the top surface of the vertical barrier rib 17*a*, asperities are formed on the surface of the dielectric layer 13 and the protective layer 14 described above. A portion of the asperities where the metal layers corresponding to the X and Y branch bus electrodes 11*c* and 12*c* are formed (convex portion 13*a*) is the thickest, which is located at the top of the vertical barrier rib 17*a*. In a discharge space, phosphor layers (18, 19, and 20) are separately applied between the barrier ribs including the side surfaces of the vertical barrier rib 17*a*. In the breadth (M) of an in-cell area, the breadth (d1) of the discharge slit and the breadth (d2) of the discharge electrode (11*b*, 12*b*) corresponding to an in-cell portion have a relation of d1>d2. As shown, d2 represents a distance from the edge of the discharge electrode (11*b*, 12*b*) on a slit side to a position on the top of the vertical barrier rib 17*a* corresponding to an end inside the cell. In a discharge space, an electric field as exemplified in the drawing occurs with a voltage being applied between the discharge electrodes.

Figure 27:
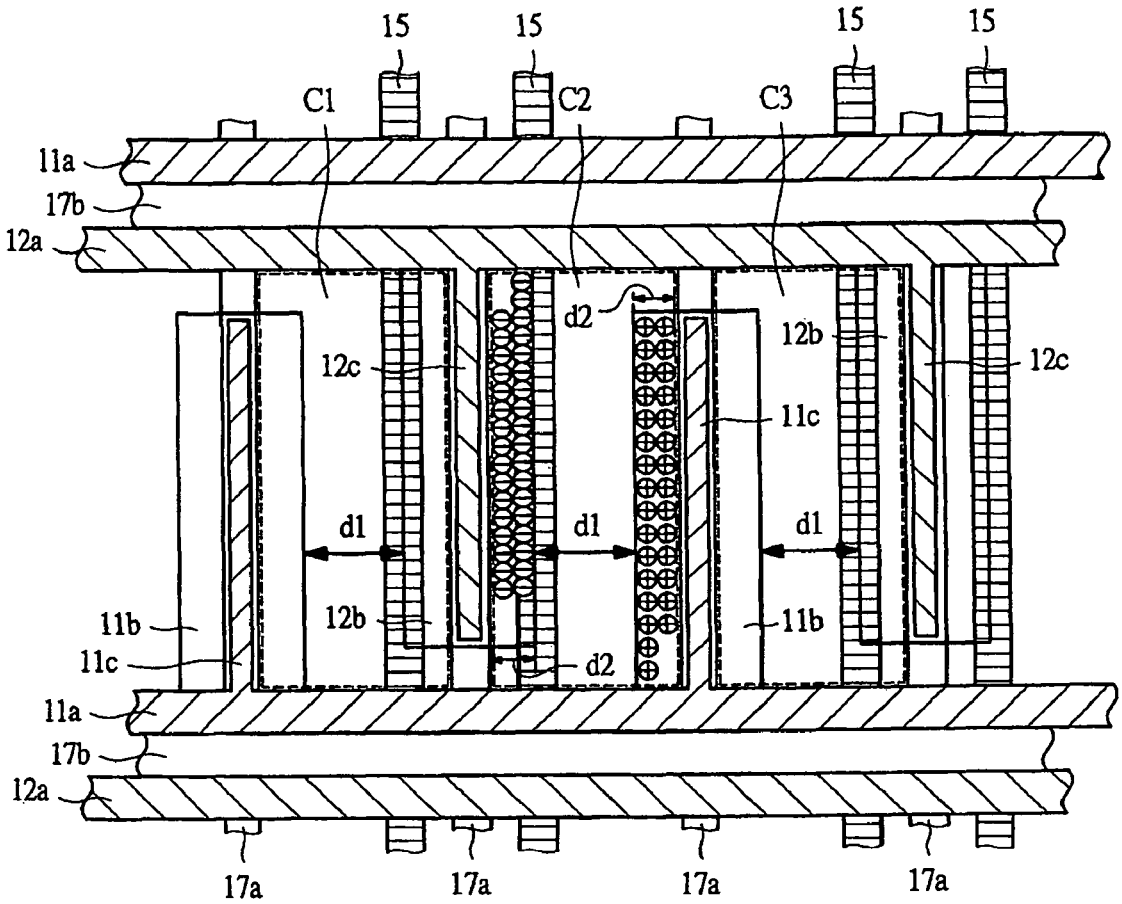
FIG. 27 is an explanatory view for showing a state in which a voltage is applied to an electrode during a sustain period in the sixth embodiment.
Figure 28:
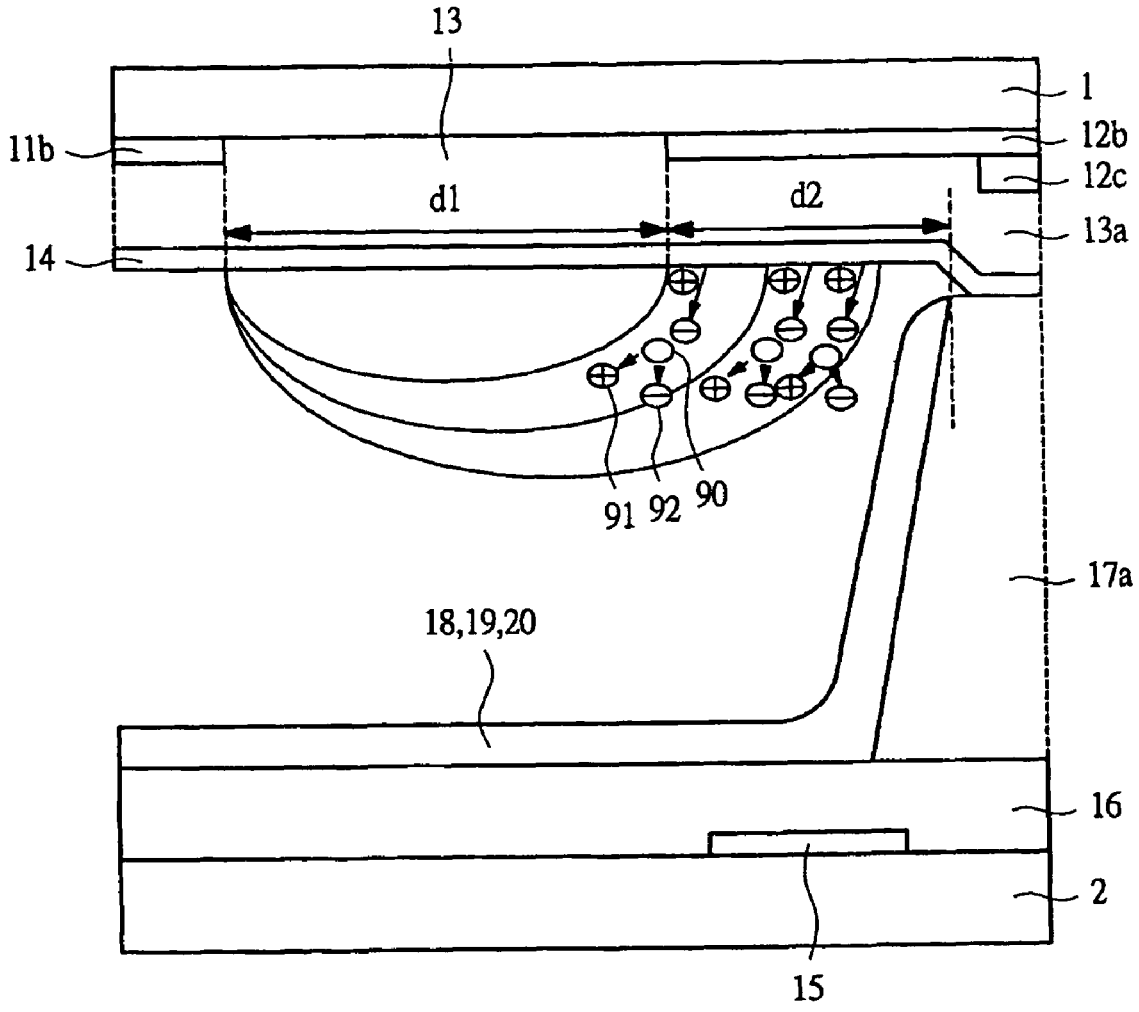
FIG. 28 is an explanatory view showing a state of applying the voltage to the electrode during the sustain period in the cross section of the PDP according to the sixth embodiment.

FIGS. 27 and 28 are conceptual views for describing a discharge mechanism near a cathode electrode (in this case, Y discharge electrode 12*b*) during the sustain period in the sixth embodiment. FIG. 28 is an enlarged view of the discharge space of FIG. 26 and depicts the state corresponding to that of FIG. 27. FIG. 27 is a drawing for describing a state of charges in the discharge electrodes 12*b* and 11*b* when the Y bus electrode 12*a* serves as a cathode and the X bus electrode 11*a* serves as an anode. With an applied voltage, in the area C2 for example, minus charges are accumulated in an in-cell portion (d2) of the Y discharge electrode 12*b* through the Y bus electrode 12*a* and the Y branch bus electrode 12*c*, whilst plus charges are accumulated in an in-cell portion (d1) of the X discharge electrode 11*b* through the X bus electrode 11*a* and the X branch bus electrode 11*c*.

In FIG. 28, when a voltage causing a potential difference Vs between the anode electrode (11*b*) and the cathode electrode (12*b*), an electric field as shown occurs in the discharge space in the cell. With this electric field, plus ions (represented by "+") near the cathode electrode (12*b*) collide with an area of the protective layer 14 near the cathode electrode (12*b*) (within the range of d2) to cause electrons (represented by "−") 92 to occur. These electrons 92 moves toward the anode electrode (11*b*) side due to the electric field. In the course of movement, the electrons 92 collides with gas molecules 90 to cause plus ions 91 and electrons 92 to occur. By repeating such a process, a discharge grows. At this time, depending on the electric field intensity, energy at the time of collision of the plus ions 91 with the protective layer 14 differs as well as energy at the time of collision of the electrons 92 with gas molecules 90. Here, the electric field is represented by a ratio between a potential difference Vs between the two electrodes and a distance therebetween. An electric field near the two electrodes can be represented as Vs/d1, whilst an electric field away therefrom can be represented as Vs/(d1+d2). Therefore, as d2 is smaller compared with d1, the electric field in the cell is more uniform, thereby making the electric field intensity in the discharge space uniform. With this, an efficient discharge is performed. For this reason, d1 and d2 described above are preferably designed to be d1>d2.

A lower limit (a width required to be allocated at minimum) of d2 described above is now described. In an AC PDP, wall charges are formed near the electrodes. Therefore, an area in which wall charges are formed, that is, a width (d2) in an in-cell portion of the transparent electrode (11*b*, 12*b*), has to be at least on the order of 30 μm (the lower limit value). Meanwhile, the vertical barrier rib 17*a* is formed of the same type of phosphor as that of the dielectric layer 13. Therefore, near a position of the vertical barrier rib 17*a* making contact with the protective layer 14 (the top surface), an electric field occurs on a side surface of the vertical barrier rib 17*a* without the protective layer 14. Therefore, part of plus ions 91 are drawn to the vertical barrier rib 17*a* side and cannot contribute the growth of the discharge. This area not allowing contribution to the discharge depends on the thickness of the dielectric layer 13. When the thickness is 30 μm, the area is approximately 30 μm, and when thickness is 10 μm, the area is approximately 10 μm to 15 μm. In accordance with the thickness of the dielectric layer 13, the length of d2 has to be determined in consideration of the size of the area not allowing contribution to the discharge.

By way of example, when the pitch of the vertical barrier ribs 17*a* is 200 μm, and the breadth of the top of the vertical barrier rib is 40 μm, assuming that the thickness of the dielectric layer 13 is 10 μm, a distance in the horizontal direction in a discharge area is 160 μm (2×d2+d1=200−40=160 μm). When it is assumed that the gap "d1" between two transparent electrodes is 70 μm, d2 is 45 μm ((160−70)/2=45 μm). This satisfies d1>d2 described above. Also even when it is assumed that an area not contributing to the above discharge is 15 μm, an area having formed thereon wall charges is equal to or longer than 30 μm (45−15=30 μm). This also satisfies d1>d2.

According to the sixth embodiment, the drive voltage can be reduced, the drive time can be shortened, and a difference in electric field can be reduced, thereby improving light-emitting efficiency. In addition, it is possible to achieve effects of reducing the amount of discharge spreading to the second substrate 2 side and mitigating changes of the phosphors (18, 19, 20) with time (these effects can be achieved by d1>d2 mentioned above).

The embodiments and modification examples according to the present invention have been described above. Various other modification examples are possible, and the feature of each of the above-described embodiments and modification examples can be applied to those other embodiments and modification examples.

As has been described in the foregoing, according to the present invention, a drive voltage when driving a PDP with its slits oriented in a vertical direction can be reduced, thereby reducing circuitry cost. With this, a PDP apparatus with a high display quality can be achieved at low cost.

(Note 1) A plasma display panel comprises: a first substrate; and a second substrate disposed opposite said first substrate and forming a discharge space in which a discharge gas is sealed between said first substrate and said second substrate, wherein said first substrate including: a plurality of first bus electrodes and a plurality of second bus electrodes arranged so as to extend in parallel with a first direction and be adjacent to each other on at least one side; a plurality of transparent first discharge electrodes drawn like teeth of a comb from each of said first bus electrodes to said second bus electrodes opposite thereto in a second direction perpendicular to said first direction; a plurality of transparent second discharge electrodes drawn like the teeth of a comb from each of said second bus electrodes to said first bus electrodes opposite thereto in said second direction; and a dielectric layer and a protective layer covering said plurality of first bus electrodes, said plurality of second bus electrodes, said plurality of first discharge electrodes, and said plurality of second discharge electrodes, said second substrate including: a plurality of third electrodes extending in parallel with said second direction; a plurality of barrier ribs extending in parallel with said second direction; and a phosphor layer formed on a surface of said second substrate and side surfaces of said barrier ribs, display cells are formed in portions at which said first bus electrodes and said second bus electrodes face each other and which is separated by said barrier ribs, said first discharge electrodes and said second discharge electrodes are disposed so as to alternately protrude from said first bus electrodes and said second discharge electrodes, and facing edges of said first discharge electrode and said second discharge electrode in each of said display cells extend in said second direction, and a gap between the facing edges of said first discharge electrode and said second discharge electrode in each of said display cells is gradually varied.

(Note 2) In the plasma display panel according to note 1, the gap between the facing edges of said first and second discharge electrodes is minimum near a center of a relevant one of said display cells in the second direction and becomes widened as moving from the center in the second direction.

(Note 3) In the plasma display panel according to note 1, the gap between the facing edges of said first and second discharge electrodes is narrow near said second bus electrode.

(Note 4) In the plasma display panel according to note 1, at least one of said first and second discharge electrodes is such that one ends of said first and second bus electrodes are different in width from that of the ends thereof.

(Note 5) In the plasma display panel according to note 4, the at least one of said first and second discharge electrodes is such that one ends of said first and second bus electrodes are narrower in width than the other ends thereof.

(Note 6) In the plasma display panel according to note 1, a first branch bus electrode drawn from each of said first bus electrodes to said second bus electrodes opposite thereto in said second direction and provided so as to overlap with at least portion of said first connect electrode, and a second branch bus electrode drawn from each of said second bus electrode to said first bus electrodes opposite thereto in said second direction and provided so as to overlap with at least portion of said second connect electrode.

(Note 7) In the plasma display panel according to any one of notes 1 to 6, said second discharge electrodes are scan electrodes that cause, together with said third electrodes, address discharges defining said display cells to be lit, and when viewed from a direction perpendicular to a display surface of the plasma display panel, areas where said third electrodes overlap with said second discharge electrodes are larger than areas where said third electrodes overlap with said first discharge electrodes.

(Note 8) In the plasma display panel according to note 7, said third electrodes are such that portions overlapping with said second discharge electrodes are large in width.

(Note 9) In the plasma display panel according to any one of notes 1 to 6, said third electrode does not overlap with said first discharge electrodes when viewed from a direction perpendicular to a display surface of the panel.

(Note 10) The plasma display panel according to note 1 further comprises: a first connect electrode connecting said first discharge electrode of one of said display cells and the first discharge electrode of another one of said display cells, which is horizontally adjacent to one side of the one of said display cells together across a relevant one of said barrier ribs; and a second connect electrode connecting said second discharge electrode of the one of said display cells and said second discharge electrode of the another one of said display cells, which is horizontally adjacent to the other side of the one of the display cells together across the relevant one of the barrier ribs.

(Note 11) In the plasma display panel according to note 10, at least a portion of said first connect electrode and said second connect electrode is provided near portions at which said first and second discharge electrodes are positioned most closely.

(Note 12) In the plasma display panel according to note 10, total width of said first and second connect electrodes in the second direction is narrower than width of each of said first and second discharge electrodes in the second direction.

(Note 13) In the plasma display panel according to note 10, total width of said first and second connect electrodes in the second direction is equal to width of each of said first and second discharge electrodes in the second direction.

(Note 14) The plasma display panel according to any one of notes 10 to 13 further comprises: a first branch bus electrode drawn from each of said first bus electrodes to said second bus electrodes opposite thereto in said second direction so as to overlap with a relevant one of said barrier ribs and provided so as to overlap with at least portion of said first connect electrode; and a second branch bus electrode drawn from each of said second bus electrode to said first bus electrodes opposite thereto in said second direction so as to overlap with a relevant one of said barrier ribs and provided so as to overlap with at least portion of said second connect electrode.

(Note 15) In the plasma display panel according to any one of notes 10 to 14, said third electrodes do not overlap with the first discharge electrodes when viewed in a direction perpendicular to a display surface of the panel.

(Note 16) In the plasma display panel according to any one of notes 10 to 14, said second discharge electrodes are scan electrodes that cause, together with said third electrodes, address discharges defining said display cells to be lit, and when viewed from a direction perpendicular to a display surface of the plasma display panel, areas where said third electrodes overlap with said second discharge electrodes are larger than areas where said third electrodes overlap with said first discharge electrodes.

(Note 17) In the plasma display panel according to note 16, said third electrodes are such that portions overlapping with the second discharge electrodes are large in width.

(Note 18) In the plasma display panel according to note 16, gaps in arrangement between said plurality of third electrodes are alternately varied.

(Note 19) In the plasma display panel according to any one of notes 10 to 18, said first and second discharge electrodes in the display cells adjacent on both sides of any one of the barrier ribs have approximately axisymmetric shapes with respect to the barrier rib.

(Note 20) In the plasma display panel according to any one of notes 10 to 18, said first discharge electrodes are different in shape from said second discharge electrodes.

(Note 21) In the plasma display panel according to any one of notes 1 to 20, a dielectric layer of said first substrate is a silicon dioxide layer formed through a vapor deposition method (Note 22) In the plasma display panel according to note 21, surfaces of the dielectric layer and the protective layer of said first substrate have asperities (concavities and convexities) in accordance with thicknesses of said first bus electrode, said second bus electrode, said first discharge electrode, and said second discharge electrode.

(Note 23) The plasma display panel according to any one of notes 1 to 22 further comprises a plurality of second barrier ribs extending in approximately parallel in said first direction, wherein said plurality of barrier ribs and said plurality of second barrier ribs form a two-dimensional barrier rib.

(Note 24) In the plasma display panel according to note 23, said plurality of second barrier ribs are disposed between said first bus electrodes and said second bus electrodes.

(Note 25) In the plasma display panel according to note 23, portions of said first bus electrodes and said second bus electrodes are disposed so as to overlap with said second barrier rib.

(Note 26) In the plasma display panel according to any one of notes 1 to 25, gaps between said first discharge electrodes and said second discharge electrodes are varied in a display cell of a different type in said phosphor layer.

(Note 27) In the plasma display panel according to any one of notes 1 to 25, one of a shape and an arrangement of said third electrode is varied in a display cell of a different type in said phosphor layer.

(Note 28) A plasma display panel comprises: a first substrate; and a second substrate disposed opposite said first substrate and forming a discharge space in which a discharge gas is sealed between said first substrate and said second substrate, wherein said first substrate including: a plurality of first bus electrodes and a plurality of second bus electrodes arranged so as to extend in parallel with a first direction and be adjacent to each other on at least one side; a plurality of transparent first discharge electrodes drawn like teeth of a comb from each of said first bus electrodes to said second bus electrodes opposite thereto in a second direction perpendicular to said first direction; a plurality of transparent second discharge electrodes drawn like the teeth of a comb from each of said second bus electrodes to said first bus electrodes opposite thereto in said second direction; and a dielectric layer and a protective layer covering said plurality of first bus electrodes, said plurality of second bus electrodes, said plurality of first discharge electrodes, and said plurality of second discharge electrodes, said second substrate including: a plurality of third electrodes extending in parallel with said second direction; a plurality of barrier ribs extending in parallel with said second direction; and a phosphor layer formed on a surface of said second substrate and side surfaces of said barrier ribs, display cells are formed in portions at which said first bus electrodes and said second bus electrodes face each other and which is separated by said barrier ribs, said first discharge electrodes and said second discharge electrodes are disposed so as to alternately protrude from said first bus electrodes and said second discharge electrodes, and facing edges of said first discharge electrode and said second discharge electrode in each of said display cells extend in said second direction, and wherein the plasma display panel further comprises: a first branch bus electrode drawn from each of said first bus electrodes to said second bus electrodes opposite thereto in said second direction so as to overlap with a relevant one of said barrier ribs and provided so as to overlap with at least portion of said first connect electrode; and a second branch bus electrode drawn from each of said second bus electrode to said first bus electrodes opposite thereto in said second direction so as to overlap with a relevant one of said barrier ribs and provided so as to overlap with at least portion of said second connect electrode.

(Note 29) A plasma display panel comprises: a first substrate; and a second substrate disposed opposite said first substrate and forming a discharge space in which a discharge gas is sealed between said first substrate and said second substrate, wherein said first substrate including: a plurality of first bus electrodes and a plurality of second bus electrodes arranged so as to extend in parallel with a first direction and be adjacent to each other on at least one side; a plurality of transparent first discharge electrodes drawn like teeth of a comb from each of said first bus electrodes to said second bus electrodes opposite thereto in a second direction perpendicular to said first direction; a plurality of transparent second discharge electrodes drawn like the teeth of a comb from each of said second bus electrodes to said first bus electrodes opposite thereto in said second direction; and a dielectric layer and a protective layer covering said plurality of first bus electrodes, said plurality of second bus electrodes, said plurality of first discharge electrodes, and said plurality of second discharge electrodes, said second substrate including: a plurality of third electrodes extending in parallel with said second direction; a plurality of barrier ribs extending in parallel with said second direction; and a phosphor layer formed on a surface of said second substrate and side surfaces of said barrier ribs, display cells are formed in portions at which said first bus electrodes and said second bus electrodes face each other and which is separated by said barrier ribs, said first discharge electrodes and said second discharge electrodes are disposed so as to alternately protrude from said first bus electrodes and said second discharge electrodes, and facing edges of said first discharge electrode and said second discharge electrode in each of said display cells extend in said second direction, and wherein the plasma display panel further comprises: a first connect electrode connecting said first discharge electrode of one of said display cells and the first discharge electrode of another one of said display cells, which is horizontally adjacent to one side of the one of said display cells together across a relevant one of said barrier ribs; and a second connect electrode connecting said second discharge electrode of the one of said display cells and said second discharge electrode of the another one of said display cells, which is horizontally adjacent to the other side of the one of the display cells together across the relevant one of the barrier ribs.

(Note 30) The plasma display panel according to note 29 further comprises: a first branch bus electrode drawn from each of said first bus electrodes to said second bus electrodes opposite thereto in said second direction so as to overlap with a relevant one of said barrier ribs and provided so as to overlap with at least portion of said first connect electrode; and a second branch bus electrode drawn from each of said second bus electrode to said first bus electrodes opposite thereto in said second direction so as to overlap with a relevant one of said barrier ribs and provided so as to overlap with at least portion of said second connect electrode.

(Note 31) A plasma display apparatus comprises: the plasma display panel according to any one of notes 1 to 30; a first electrode drive circuit for applying a drive signal to said plurality of first bus electrodes; a second electrode drive circuit for applying a drive signal to said plurality of second bus electrodes; and a third electrode drive circuit for applying a drive signal to said plurality of third electrodes.

As described above, according to the present invention, since the drive voltage can be made lower when the slit drives the longitudinal-directional PDP, the manufacture costs of the circuits can be reduced. Thereby, the PDP apparatus with good display quality can be achieved at the low cost.

The present invention is suitable for the PDP, particularly, the highly fine panel.

What is claimed is:

1. A plasma display panel comprising:

a first substrate; and a second substrate disposed opposite said first substrate and forming a discharge space in which a discharge gas is sealed between said first substrate and said second substrate, wherein said first substrate including:

a plurality of first bus electrodes and a plurality of second bus electrodes arranged so as to extend in parallel with a first direction and be adjacent to each other on at least one side;

a plurality of transparent first discharge electrodes drawn like teeth of a comb from each of said first bus electrodes to said second bus electrodes opposite thereto in a second direction perpendicular to said first direction;

a plurality of transparent second discharge electrodes drawn like the teeth of a comb from each of said second bus electrodes to said first bus electrodes opposite thereto in said second direction; and a dielectric layer and a protective layer covering said plurality of first bus electrodes, said plurality of second bus electrodes, said plurality of first discharge electrodes, and said plurality of second discharge electrodes, said second substrate including:

a plurality of third electrodes extending in parallel with said second direction;

a plurality of barrier ribs extending in parallel with said second direction; and a phosphor layer formed on a surface of said second substrate and side surfaces of said barrier ribs, display cells are formed in portions at which said first bus electrodes and said second bus electrodes face each other and said first discharge electrodes and said second discharge electrodes face each other and which is separated by said barrier ribs, said first discharge electrodes and said second discharge electrodes are disposed so as to alternately protrude from said first bus electrodes and said second discharge electrodes, and facing edges of said first discharge electrode and said second discharge electrode in each of said display cells extend in said second direction, and a gap between the facing edges of said first discharge electrode and said second discharge electrode in each of said display cells is gradually varied;

the plasma display panel further comprising:

a first connect electrode connecting said first discharge electrode of one of said display cells and the first discharge electrode of another one of said display cells, which is horizontally adjacent to one side of the one of said display cells together across a relevant one of said barrier ribs; and a second connect electrode connecting said second discharge electrode of the one of said display cells and said second discharge electrode of the another one of said display cells, which is horizontally adjacent to the other side of the one of the display cells together across the relevant one of the barrier ribs;

wherein said second discharge electrodes are scan electrodes that cause, together with said third electrodes, address discharges defining said display cells to be lit, and when viewed from a direction perpendicular to a display surface of the plasma display panel, areas where said third electrodes overlap with said second discharge electrodes are larger than areas where said third electrodes overlap with said first discharge electrodes.

2. A plasma display panel comprising:

a first substrate; and a second substrate disposed opposite said first substrate and forming a discharge space in which a discharge gas is sealed between said first substrate and said second substrate, wherein said first substrate includes:

a plurality of first bus electrodes and a plurality of second bus electrodes arranged so as to extend in approximately parallel with a first direction and be adjacent to each other on at least one side;

a plurality of transparent first discharge electrodes drawn like teeth of a comb from each of said first bus electrodes to said second bus electrodes opposite thereto in a second direction perpendicular to said first direction;

a plurality of transparent second discharge electrodes drawn like the teeth of a comb from each of said second bus electrodes to said first bus electrodes opposite thereto in said second direction; and a dielectric layer and a protective layer covering said plurality of first bus electrodes, said plurality of second bus electrodes, said plurality of first discharge electrodes, and said plurality of second discharge electrodes, said second substrate includes:

a plurality of third electrodes extending in approximately parallel with said second direction;

a plurality of barrier ribs extending in approximately parallel with said second direction and partitioning display cells; and a phosphor layer formed on a surface of said second substrate and side surfaces of said barrier ribs, said display cells are formed in portions at which said first bus electrodes and said second bus electrodes face each other and said first discharge electrodes and said second discharge electrodes face each other and which is separated by said barrier ribs, and a distance between the first and second discharge electrodes is longer than a width of the first and second discharge electrodes in the display cell.

3. The plasma display panel according to claim 2, wherein in said first direction of each of said display cells, the distance between said first and second discharge electrodes is longer than a distance from each of facing edges of said distance between said first and second discharge electrodes to an upper end of a side surface of a relevant one of said barrier ribs.

4. The plasma display panel according to claim 3, wherein said first and second discharge electrodes are integrally formed across said barrier ribs so as to be shared between said display cells adjacent in said first direction.

5. The plasma display panel according to claim 3, wherein the distance between said first and second discharge electrodes in said first direction becomes narrowest near a center of said display cell in said second direction and becomes gradually widened toward an end of the distance.

6. The plasma display panel according to claim 3, further comprising:

a first connect electrode electrically connecting said first discharge electrode of one of said display cells and the first discharge electrode of another one of said display cells, which is horizontally adjacent to one side of the one of said display cells together across a relevant one of said barrier ribs; and a second connect electrode electrically connecting said second discharge electrode of the one of said display cells and said second discharge electrode of the another one of said display cells, which is horizontally adjacent to the other side of the one of the display cells together across the relevant one of the barrier ribs.

7. The plasma display panel according to claim 2, wherein said first and second discharge electrodes are integrally formed across said barrier ribs so as to be shared between said display cells adjacent in said first direction.

8. The plasma display panel according to claim 7, wherein the distance between said first and second discharge electrodes in said first direction becomes narrowest near a center of said display cell in said second direction and becomes gradually widened toward an end of the distance.

9. The plasma display panel according to claim 7, further comprising:

a first connect electrode electrically connecting said first discharge electrode of one of said display cells and the first discharge electrode of another one of said display cells, which is horizontally adjacent to one side of the one of said display cells together across a relevant one of said barrier ribs; and a second connect electrode electrically connecting said second discharge electrode of the one of said display cells and said second discharge electrode of the another one of said display cells, which is horizontally adjacent to the other side of the one of the display cells together across the relevant one of the barrier ribs.

10. The plasma display panel according to claim 2, wherein the distance between said first and second discharge electrodes in said first direction becomes narrowest near a center of said display cell in said second direction and becomes gradually widened toward an end of the distance.

11. The plasma display panel according to claim 10, further comprising:

a first branch bus electrode provided so as to be drawn from each of said first bus electrodes to said second bus electrodes opposite thereto in said second direction and to overlap with an upper portion of a relevant one of said barrier ribs; and a second branch bus electrode provided so as to be drawn from each of said second bus electrode to said first bus electrodes opposite thereto in said second direction and to overlap with an upper portion of a relevant one of said barrier ribs.

12. The plasma display panel according to claim 2, further comprising:

a first connect electrode electrically connecting said first discharge electrode of one of said display cells and the first discharge electrode of another one of said display cells, which is horizontally adjacent to one side of the one of said display cells together across a relevant one of said barrier ribs; and a second connect electrode electrically connecting said second discharge electrode of the one of said display cells and said second discharge electrode of the another one of said display cells, which is horizontally adjacent to the other side of the one of the display cells together across the relevant one of the barrier ribs.

* * * * *